US009738113B2

(12) United States Patent
Tani

(10) Patent No.: US 9,738,113 B2
(45) Date of Patent: Aug. 22, 2017

(54) MULTI PENCIL

(71) Applicant: TOKIWA CORPORATION, Nakatsugawa-shi, Gifu (JP)

(72) Inventor: Yoshikazu Tani, Kawaguchi (JP)

(73) Assignee: TOKIWA CORPORATION, Nakatsugawa (JP)

( * ) Notice: Subject to any disclaimer, the term of this patent is extended or adjusted under 35 U.S.C. 154(b) by 247 days.

(21) Appl. No.: 14/685,816

(22) Filed: Apr. 14, 2015

(65) Prior Publication Data

US 2015/0343832 A1 Dec. 3, 2015

(30) Foreign Application Priority Data

Jun. 3, 2014 (JP) ..... 2014-114690

(51) Int. Cl.
*B43K 24/16* (2006.01)
*A45D 40/24* (2006.01)
(Continued)

(52) U.S. Cl.
CPC ..... *B43K 24/163* (2013.01); *B43K 27/04* (2013.01); *A45D 40/24* (2013.01); *A45D 2040/208* (2013.01)

(58) Field of Classification Search
CPC combination set(s) only.
See application file for complete search history.

(56) References Cited

U.S. PATENT DOCUMENTS 5,056,179 A * 10/1991 Capponi ..... A45D 40/20 132/218
5,749,663 A * 5/1998 Takahashi ..... B43K 27/02 401/31

(Continued)

FOREIGN PATENT DOCUMENTS

JP 63-103778 U 7/1988
JP 5-39418 U 5/1993
JP 3122198 U 6/2006

OTHER PUBLICATIONS

Office Action dated Jan. 13, 2017, issued in counterpart Chinese Application No. 201510164594.4, with English translation (10 pages).

(Continued)

*Primary Examiner* — David Walczak
(74) *Attorney, Agent, or Firm* — Westerman, Hattori, Daniels & Adrian, LLP

(57) ABSTRACT

A multi pencil includes a cylindrical main body, a cylindrical leading tube engaged with the main body, and a plurality of sliding parts that are each coupled with a plurality of drawing materials held in the interior of the leading tube and slidably provided by a constant distance with respect to the main body. Regarding this configuration, one arbitrary sliding part, out of the plurality of sliding parts, moves forward by a constant distance with respect to the main body, whereby the drawing material coupled with the sliding part is exposed from the leading tube, and in this state, the leading tube and the main body are relatively rotated in one direction, which allows the drawing material to move forward. In the multi pencil, the forward movement of the drawing material is regulated by the relative rotation of the leading tube and the main body in the one direction.

27 Claims, 15 Drawing Sheets

(51) Int. Cl.
*B43K 27/04* (2006.01)
*A45D 40/20* (2006.01)

(56) References Cited

U.S. PATENT DOCUMENTS 6,106,179 A * 8/2000 Kuo ..... B43K 24/146
401/30
6,217,241 B1 * 4/2001 Kobayashi ..... B43K 24/14
401/195

OTHER PUBLICATIONS

Office Action dated Feb. 14, 2017, issued in counterpart Japanese Application No. 2014-114690, with English translation (6 pages).

* cited by examiner

MULTI PENCIL

TECHNICAL FIELD

The present invention relates to a multi pencil used in a manner that one out of a plurality of drawing materials is thrust.

BACKGROUND ART

As a conventional multi pencil, for example, there has been known a multi pencil disclosed in Japanese Unexamined Utility Model Application Publication No. 1993-39418 (Patent Literature 1). Patent Literature 1 discloses a cosmetic material feed container that includes a cylindrical main body inclusive of a plurality of longitudinal holes, and a tapered tube rotatably fitted to the frontal portion of the main body and formed in such a manner that the frontal portion contracts, as constitutional elements in its appearance. A plurality of thrust pieces that include a push button projected from the longitudinal hole of the main body, a plurality of screw tubes coupled with the frontal portion of each thrust piece, a plurality of coupling pipes rotatably coupled with the frontal portion of each screw tube, and a plurality of holding tubes provided in the frontal portion of each coupling pipe are provided in the interior of the cosmetic material feed container. A square-shaped insertion hole is provided in the tip end portion of the tapered tube, and the holding tube is formed in a square shape in such a manner as to be inserted into the insertion hole of the tapered tube. Also, a push rod that includes a projection is inserted into the interior of the screw tube and the coupling pipe, and the projection of the push rod is threadedly engaged with a screw in the screw tube. A core chuck in which a rod-shaped cosmetic material is mounted is coupled with the frontal portion of the push rod.

Regarding the cosmetic material feed container disclosed in the above-mentioned Patent Literature 1, when one thrust piece is moved forward along the longitudinal hole, the screw tube, the coupling pipe, the holding tube, the push rod, and the core chuck integrally move forward. Then, the holding tube advances along the inner surface of the tapered tube and is unrotatably inserted into the insertion hole in a state where the screw tube and the coupling pipe are bent. In this state, when the tapered tube is rotated in one direction with respect to the main body, the holding tube, the coupling pipe, and the push rod rotate with the tapered tube. Then, the push rod advances with respect to the screw tube, and the core chuck advances in response to the movement of the push rod, thereby thrusting the cosmetic material from the holding tube to the front.

CITATION LIST

Patent Literature

Patent Literature 1: Japanese Unexamined Utility Model Application Publication No. 1993-39418

SUMMARY OF INVENTION

Problems to be Solved by the Invention

Regarding the above-mentioned cosmetic material feed container, when the tapered tube is rotated with respect to the main body in the other direction, the push rod moves backward with respect to the screw tube. The core chuck coupled with the frontal portion of the push rod holds the drawing material such as a rod-shaped cosmetic material, so that the drawing material held by the core chuck is also returned backward in response to the backward movement of the push rod. Thus, it is configured such that the drawing material is moved backward in a state where the core chuck holds the drawing material, so that the drawing material needs to be constituted of a rigid material in some extent. Accordingly, there is a problem in that the drawing material formed of soft materials cannot be applied. Also, regarding the above-mentioned cosmetic material feed container, a situation is assumed in which the drawing material is moved backward more than necessary. In this case, the drawing material needs to be additionally moved forward in the next round of use, so that there is room for improvement in terms of usability.

Accordingly, in view of the aforementioned problems, it is an object of the present invention to provide a multi pencil in which a drawing material constituted of a soft material can be used, and usability can be improved.

Solution to Problems

In order to solve the problem described above, the multi pencil according to an embodiment of the present invention may include a cylindrical main body, a cylindrical leading tube configured to be engaged with the main body, and a plurality of sliding parts configured to be each coupled with a plurality of drawing materials held in an interior of the leading tube and configured to be slidably provided by a constant distance with respect to the main body, wherein one arbitrary sliding part, out of the plurality of sliding parts, moves forward by a constant distance with respect to the main body, whereby the drawing material coupled with the one arbitrary sliding part is exposed from the leading tube, and in this state, the leading tube and the main body are relatively rotated in one direction, which allows the drawing material to move forward, and wherein only a forward movement of the drawing material is regulated by the relative rotation of the leading tube and the main body in the one direction.

In the multi pencil, the drawing material is coupled with each sliding part, and one arbitrary sliding part moves forward by a constant distance with respect to the main body, whereby the drawing material coupled with the one arbitrary sliding part is exposed from the leading tube. Then, in this state, the leading tube and the main body are relatively rotated in one direction, whereby the drawing material is configured to move forward, and furthermore, only the forward movement of the drawing material is regulated. Thus, it is configured that it only needs to consider the thrust of the drawing material to the front side by means of the relative rotation in the one direction. Accordingly, for example, this eliminates the constitution in which the drawing material is moved backward while being held, so that the drawing material, which is made of soft materials that are difficult to hold, can be applied to the multi pencil. Also, regarding the multi pencil of the present invention, the drawing material is not moved backward, so that there is no problem in that the drawing material needs to be additionally moved forward in the next round of use. Consequently, the usability can be improved.

As preferred constitution in which the above-mentioned actions and effects are provided, specifically, constitution is exemplified, wherein a ratchet mechanism is provided that allows the relative rotation of the leading tube and the main body in the one direction and regulates the relative rotation of the leading tube and the main body in other direction, which is opposite to the one direction.

Also, the multi pencil may include an inner tube positioned on the front side of the main body, and the ratchet mechanism includes protruding portions that protrude from an outer surface of the inner tube and have elasticity in a radial direction, and concave and convex portion that is provided on an inner surface of the leading tube and rotatably engaged with the protruding portions. In this case, the protruding portions that protrude from the outer surface of the inner tube and the concave and convex portion that is provided on the inner surface of the leading tube can be utilized as the ratchet mechanism.

Also, the protruding portions of the inner tube may be abutted with the concave and convex portion of the leading tube at all times. Thus, when the protruding portions that protrude from the outer surface of the inner tube and the concave and convex portion that is provided on the inner surface of the leading tube are closely disposed with each other at all times, resistance can be generated at all times between the outer surface of the inner tube and the inner surface of the leading tube, so that unsteadiness between the inner tube and the leading tube can be restrained.

Also, the multi pencil may include a pipe member configured to be positioned in an interior of the leading tube, the pipe member in which the drawing material is loaded, a movable body configured to extend in an axial direction on a rear side of the drawing material and configured to include a male screw having infinitesimal pitches on an outer circumference, and a screw tube configured to be synchronously rotatably engaged with a rear side of the pipe member and configured to include a female screw that is threadedly engaged with the male screw on an inner circumference, wherein the sliding part moves forward by a constant distance with respect to the main body, which allows the pipe member to move forward and engage the leading tube in a rotational direction, and wherein, in this state, the leading tube and the main body are relatively rotated in the one direction, whereby the movable body moves forward with the drawing material by action of a screw-threaded engagement between the male screw and the female screw. In this case, the male screws formed on the outer circumference of the movable body have infinitesimal pitches, so that the shifting amount of the movable body by means of the relative rotation in one direction is also infinitesimal. Accordingly, the fine adjustment of the drawing material that is thrust forward can be made, and the malfunction that the drawing material thrust out is snapped can be prevented, so that the usability can further be improved.

Also, it may be such that a front end of the movable body is formed in a cylindrical shape having a flat bottom surface, and the bottom surface thrusts the drawing material forward, which allows the drawing material to move forward. In this case, this eliminates the core chuck that holds the drawing material, so that the drawing material is configured to be thrust out by the bottom surface of the front end of the cylindrical movable body.

Also, the multi pencil may include a holding member configured to be arranged on a rear side of the screw tube and hold the movable body inside, wherein a cross section of the movable body is formed in a non-circular shape, and wherein the holding member includes a hole part formed in a non-circular shape in accordance with a cross-sectional shape of the movable body. In this case, the movable body, whose cross section is formed in a non-circular shape, is inserted into the hole part formed in a non-circular shape, which allows the engagement of the movable body with the holding member in the rotational direction, so that the holding member can function as a rotational stop for the movable body.

Also, the holding member may include an elastic portion configured to provide the movable body inserted in the hole part with an elastic force from an outer side. In this case, the movable body in the hole part can be held by the elastic force of the elastic portion from the outer side, so that the movable body can be mounted on the holding member by the application of the elastic force, and the movable body can be detached from the holding member by releasing the elastic force, and the movable body can be mounted on and detached from the holding member in an easy manner.

Advantageous Effects of Invention

According to an embodiment of the present invention, a drawing material constituted of a soft material can be used, and usability can be improved.

DESCRIPTION OF EMBODIMENTS

Hereinafter, the embodiments of the present invention will be described referring to drawings. It is noted that the same or corresponding elements are designated as the same references in the description below, and duplicated descriptions are omitted.

Figure 1:
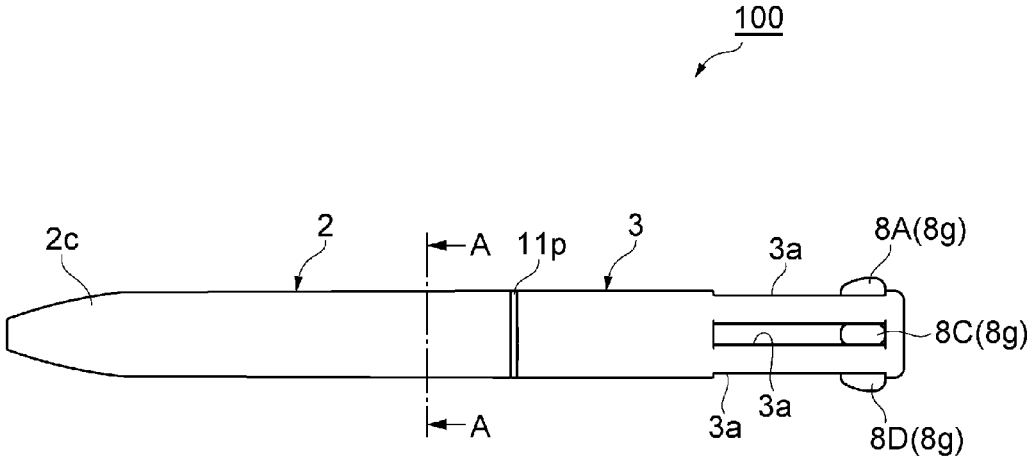
FIG. 1 is a side view illustrating a multi pencil according to the present embodiment.
Figure 2:
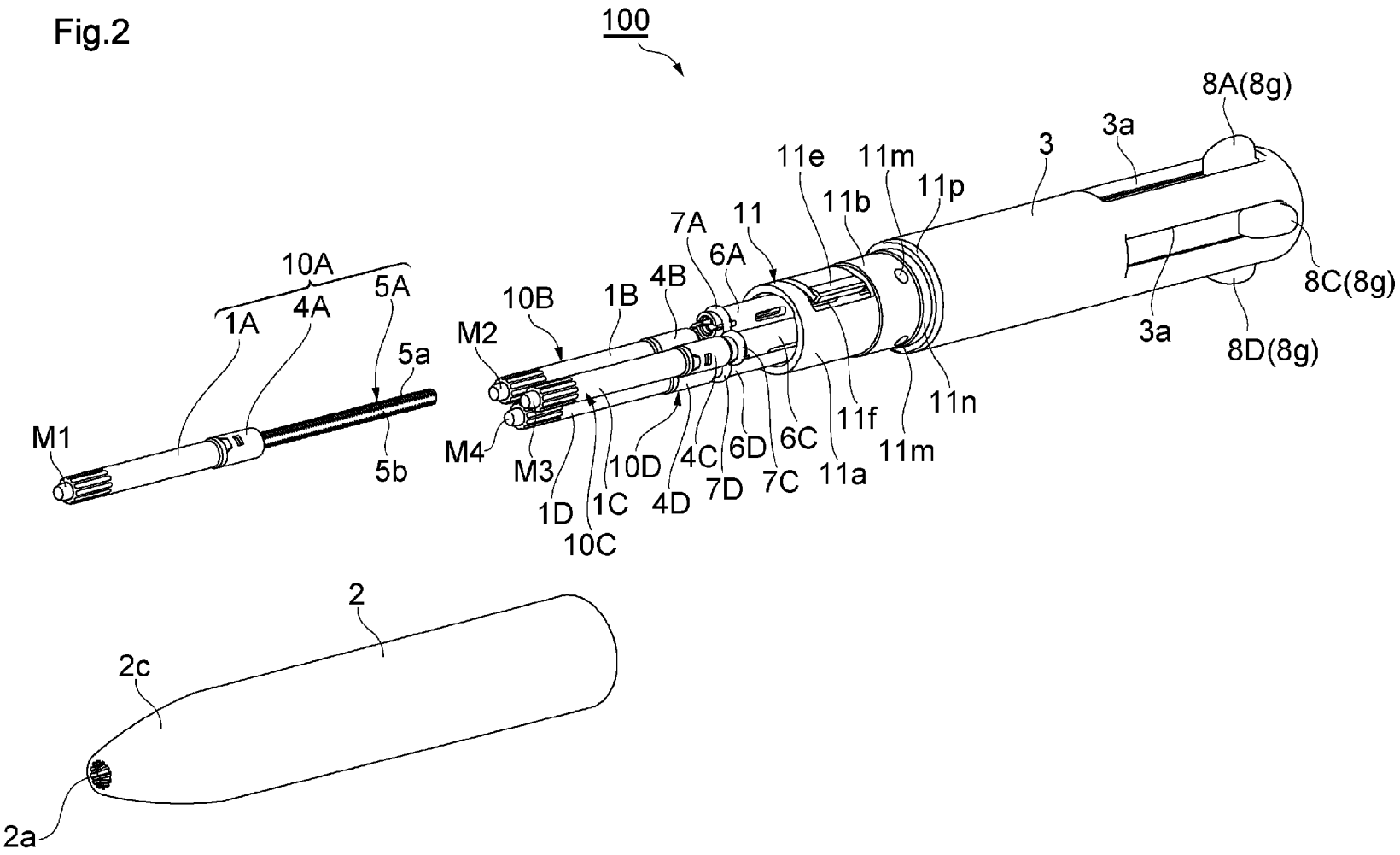
FIG. 2 is a perspective view illustrating a state where a leading tube and a cartridge are detached from the multi pencil of FIG. 1.

FIG. 1 is a side view illustrating the outer appearance of a multi pencil according to the present embodiment. FIG. 2 is a perspective view illustrating a state where a leading tube and a cartridge are detached from the multi pencil of FIG. 1. As illustrated in FIGS. 1 and 2, regarding a multi pencil 100 of the present embodiment, any of a plurality of drawing materials M1 to M4 loaded in the respective interiors of four pipe members 1A to 1D is appropriately discharged (thrust out) through the operation of a user. In the present embodiment, the drawing materials M1 to M4 represent drawing materials each having a different color.

For example, rod-shaped cores such as various rod-shaped cosmetic materials or writing materials, which are exemplified by lip sticks, lip glosses, eyeliners, eyebrows, lip liners, cheek rouges, concealers, cosmetic sticks, and sticks used for hair coloring or nail art, can be applied for the drawing materials M1 to M4. Furthermore, it is preferable that a very soft rod-shaped member (a semisolid, soft-solid, soft, gelatinous, or mousse-like rod-shaped member, or a pasty member inclusive of the above-mentioned states) be used. Also, a small-diameter rod-shaped member whose outer diameter is equal to or less than 1.0 mm, a general rod-shaped member whose outer diameter ranges from 1.5 to 3.0 mm, and a thick rod-shaped member whose outer diameter is equal to or higher than 4.0 mm can be used.

The multi pencil 100 includes a leading tube 2 that includes the pipe members 1A to 1D inside, to which the drawing materials M1 to M4 are loaded, and a main body 3 that is coupled with the rear end portion of the leading tube 2 and relatively rotatably engaged with the leading tube 2, as constitutional elements in its appearance. In the description below, "axial line" represents the center line of the multi pencil 100, which extends in the back and front of the multi pencil 100, and "axial direction" represents the back-and-forth direction along with the axial line. Also, a direction that the drawing materials M1 to M4 are fed is represented as a forward direction (advancing direction), and a direction opposite to the forward direction is represented as a rearward direction.

A screw tube 4A is synchronously rotatably engaged with the rear portion of the pipe member 1A, and a rod-shaped movable body 5A that includes a male screw 5*a* is threadedly engaged with the interior of the screw tube 4A. A cartridge 10A that is exchangeable with respect to the main body 3 is constituted by the pipe member 1A, the screw tube 4A, and the movable body 5A. The constitution of the pipe members 1B to 1D is the same as that of the pipe member 1A, and respective cartridges 10B to 10D are constituted by the pipe members 1B to 1D, screw tubes 4B to 4D, movable bodies 5B to 5D.

Figure 3:
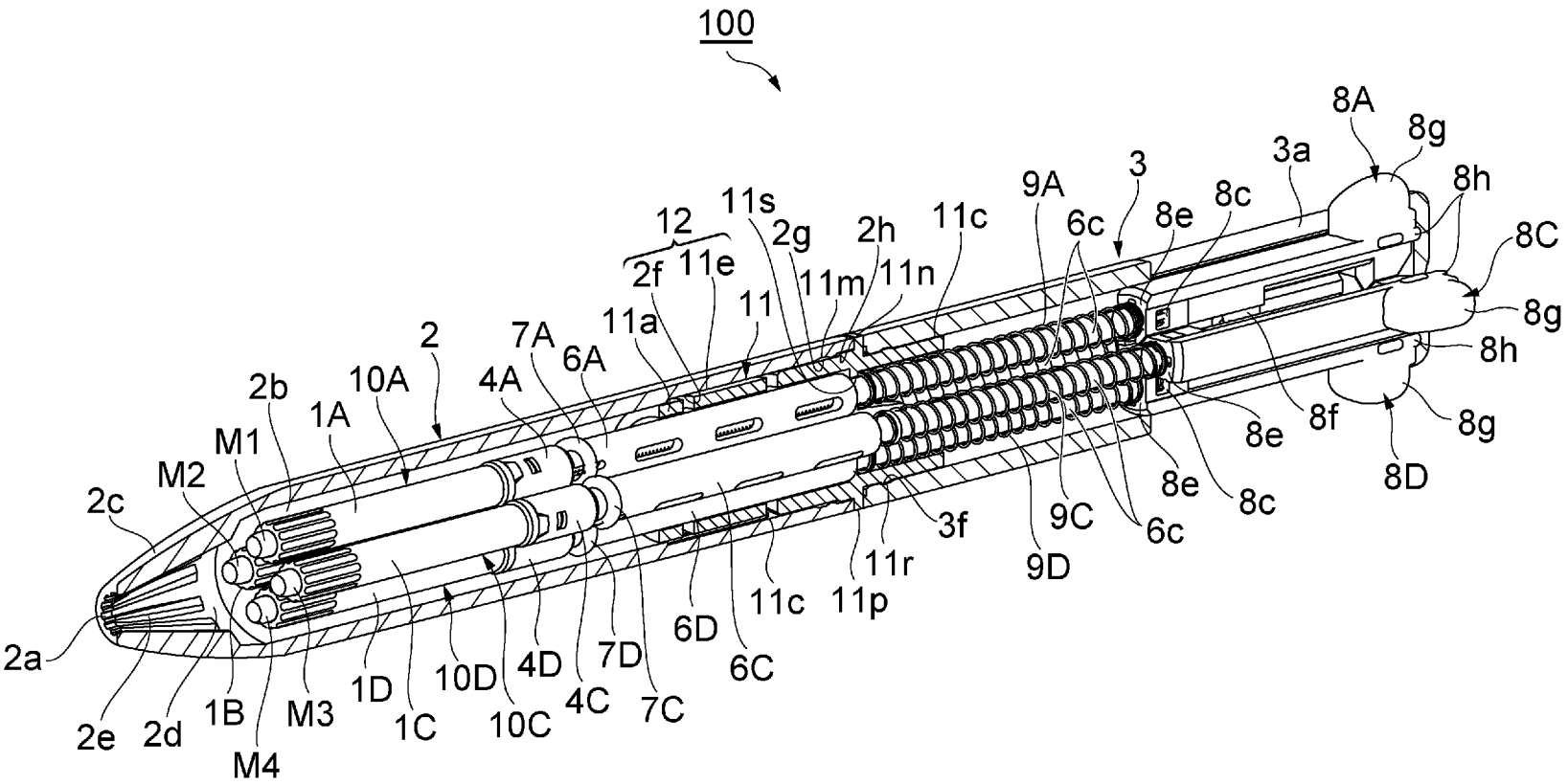
FIG. 3 is a cross-sectional perspective view illustrating the multi pencil of FIG. 1.
Figure 4:
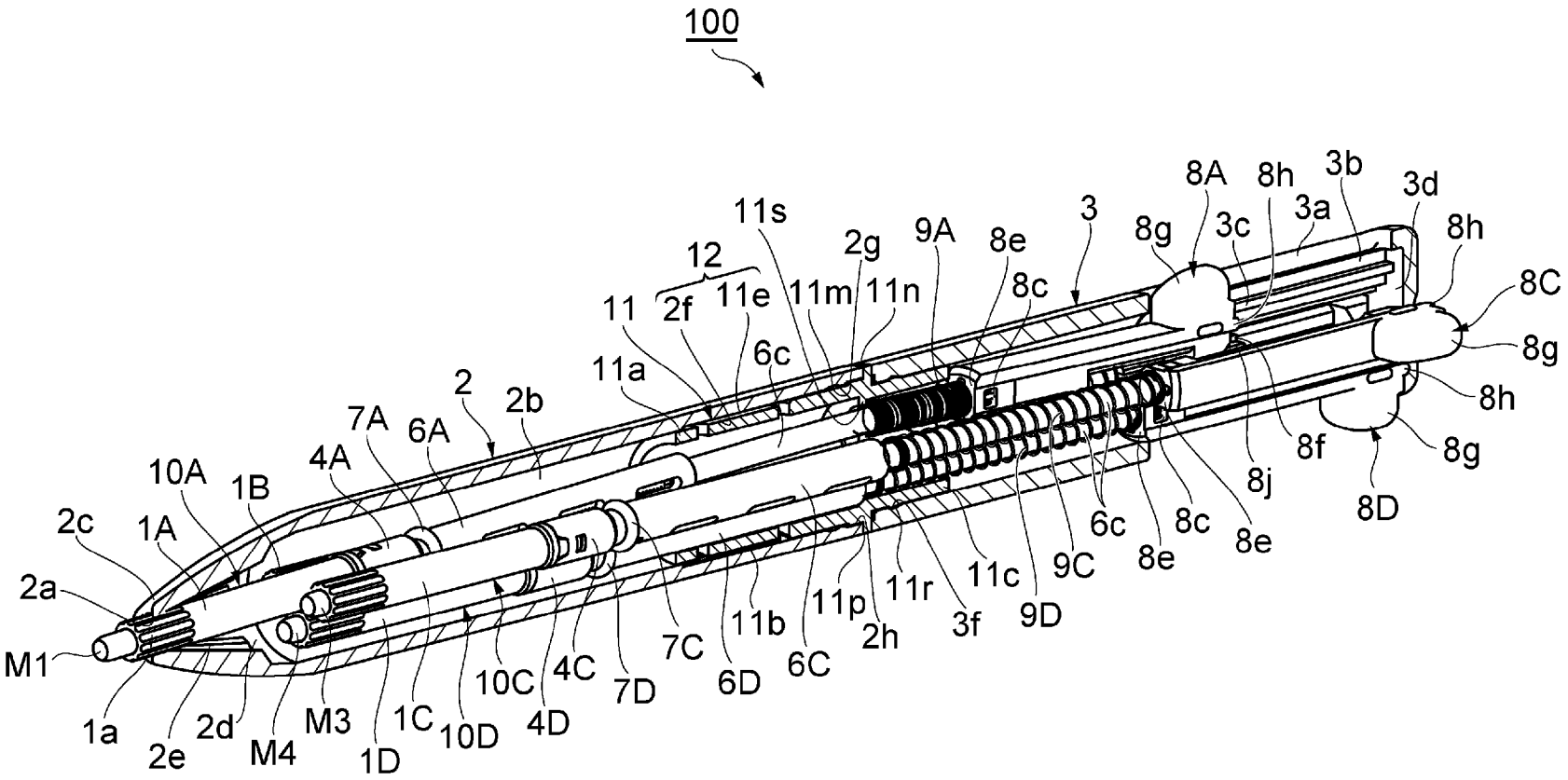
FIG. 4 is a cross-sectional perspective view illustrating a state where a sliding part is moved forward in the multi pencil of FIG. 1.
Figure 5:
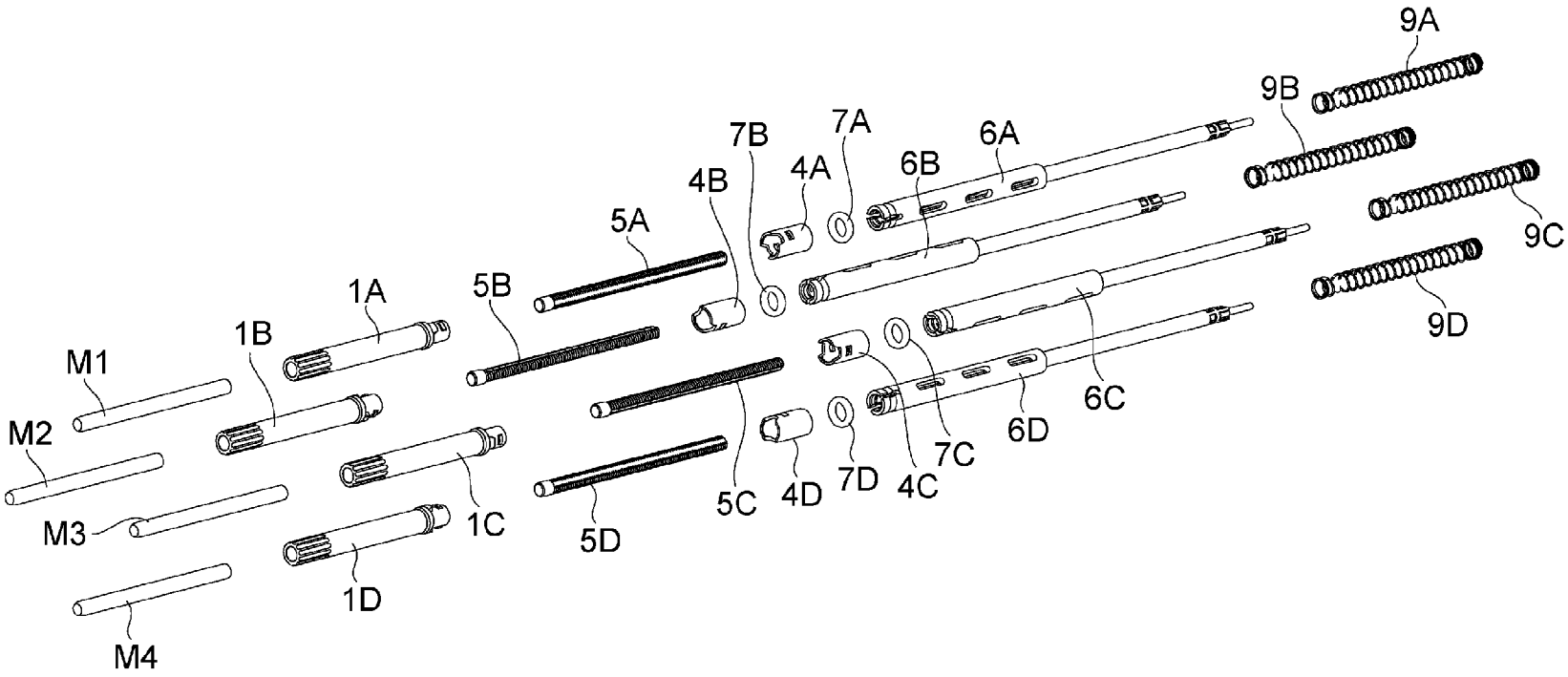
FIG. 5 is a perspective view illustrating each component arranged on the inner side of the multi pencil of FIG. 1.

As described in FIGS. 2 to 4, a cylindrical holding member 6A that holds the movable body 5A, an O-ring (elastic portion) 7A that provides the holding member 6A with an elastic force from the outer side, a sliding part 8A that is synchronously rotatably engaged with the holding member 6A at the rear portion of the holding member 6A, and a spring 9A that energizes the sliding part 8A backward are provided in the rear portion of the cartridge 10A. Also, as illustrated in FIGS. 3 to 5, holding members 6B to 6D, O-rings 7B to 7D, sliding parts 8B to 8D, and springs 9B to 9D are provided in the respective rear portions of the cartridges 10B to 10D, as is the same with the cartridge 10A.

As described above, the pipe members 1A to 1D in which the drawing materials M1 to M4 are loaded, the movable bodies 5A to 5D, the screw tubes 4A to 4D, the O-rings 7A to 7D, the holding members 6A to 6D, the springs 9A to 9D, and the sliding parts 8A to 8D are provided in the interior of the leading tube 2 and the main body 3. Respective constitutions are the same, regarding the pipe members 1A to 1D, the movable bodies 5A to 5D, the screw tubes 4A to 4D, the O-rings 7A to 7D, the holding members 6A to 6D, the springs 9A to 9D, and the sliding parts 8A to 8D, except that any one of the drawing materials M1 to M4, each of which has a different color, is loaded.

Accordingly, in the description below, the pipe members 1A to 1D, the movable bodies 5A to 5D, the screw tubes 4A to 4D, the O-rings 7A to 7D, the holding members 6A to 6D, the springs 9A to 9D, and the sliding parts 8A to 8D are merely referred to respectively as the pipe member 1, the movable body 5, the screw tube 4, the O-ring 7, the holding member 6, the spring 9, and the sliding part 8. Also, the cartridges 10A to 10D and the drawing materials M1 to M4 are merely referred to respectively as the cartridge 10 and the drawing material M.

Figure 6:
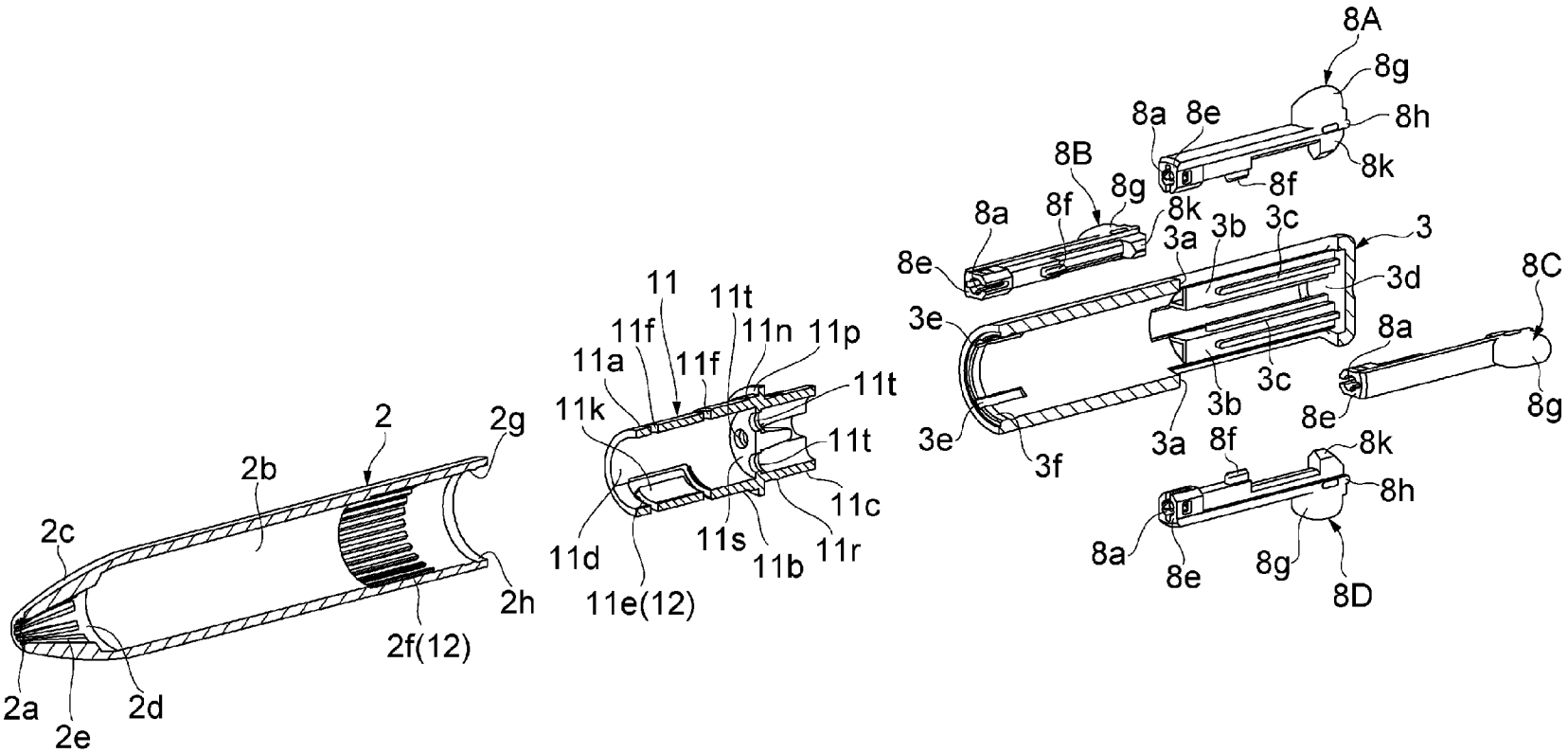
FIG. 6 is a perspective view illustrating each component constituting the outer appearance of the multi pencil of FIG. 1.

As illustrated in FIGS. 3, 4 and 6, an inner tube 11 is synchronously rotatably engaged with the front end of the main body 3, and four holding members 6 are held in the interior of the inner tube 11. Also, a ratchet mechanism 12, which allows the relative rotation of the leading tube 2 and the main body 3 (inner tube 11) only in one direction, is provided in the inner tube 11 and the leading tube 2. The relative rotation of the leading tube 2 and the main body 3 in the other direction, which is opposite to the one direction, is regulated by the ratchet mechanism 12.

Figure 7:
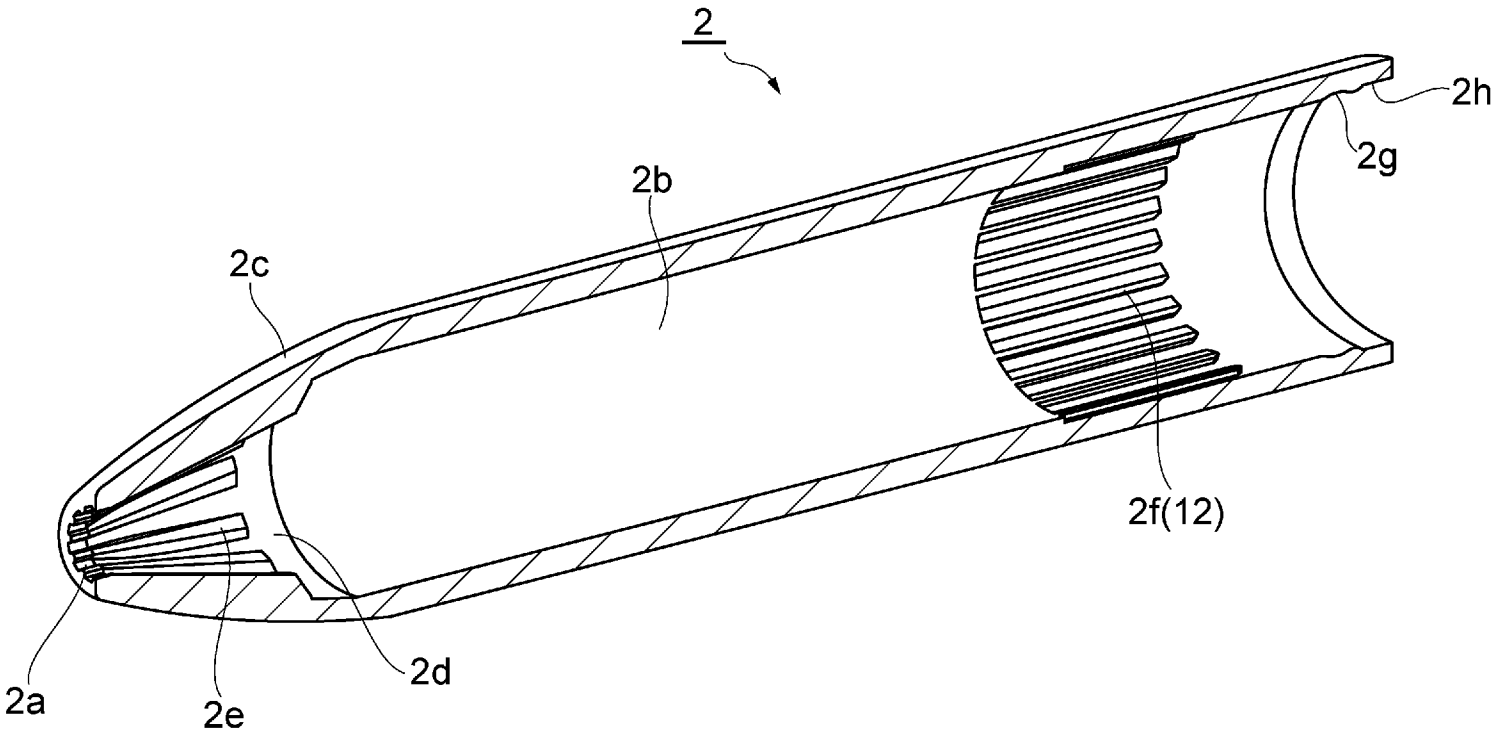
FIG. 7 is a cross-sectional perspective view of the leading tube.

FIG. 7 is an enlarged, cross-sectional perspective view of the leading tube 2 of FIG. 6. As illustrated in FIG. 7, the leading tube 2 is formed of acrylonitrile butadiene styrene copolymerized synthetic resin (ABS resin) in a cylindrical shape and includes an opening portion 2*a* that allows the front-side portion of the pipe member 1 to emerge at the tip end. A storage area 2*b* that stores the four cartridges 10 and the four holding members 6 is provided in the interior of the leading tube 2, and any of the four pipe members 1 provided in the storage area 2*b* is exposed forward from the opening portion 2*a* in accordance with the operation of the user.

An inclined surface 2*c*, which inclines in such a manner as to taper off as it goes to the front, is provided on the front side on the outer circumferential surface of the leading tube 2. The inner circumferential surface 2*d* of the leading tube 2 on the front side also tapers off as it goes to the front side. A multitude of convex portions are disposed in parallel on the inner circumferential surface 2*d* in the circumferential direction, as sections engaged with the pipe member 1 in the rotational direction (direction around the axial line), and protrusions 2*e* formed by the convex portions extended by a predetermined length in the inclined direction of the inner circumferential surface 2*d* are provided. The intervals between the protruding portions of the protrusions 2*e* narrow as the protrusions 2*e* advance to the front side.

On the rear portion side on the inner circumferential surface of the leading tube 2, concave and convex portion 2*f* that constitutes one of the ratchet mechanism 12 is provided. 24 projections and depressions are disposed in parallel in the circumferential direction of the concave and convex portion 2*f*, and each of the projection extends in the axial direction. Also, annular concave portions 2*g* and 2*h* engaged with the inner tube 11 in the rear portion of the leading tube 2 in the axial direction are provided on the rear side of the concave and convex portion 2*f* on the inner circumferential surface of the leading tube 2.

Figure 8A:
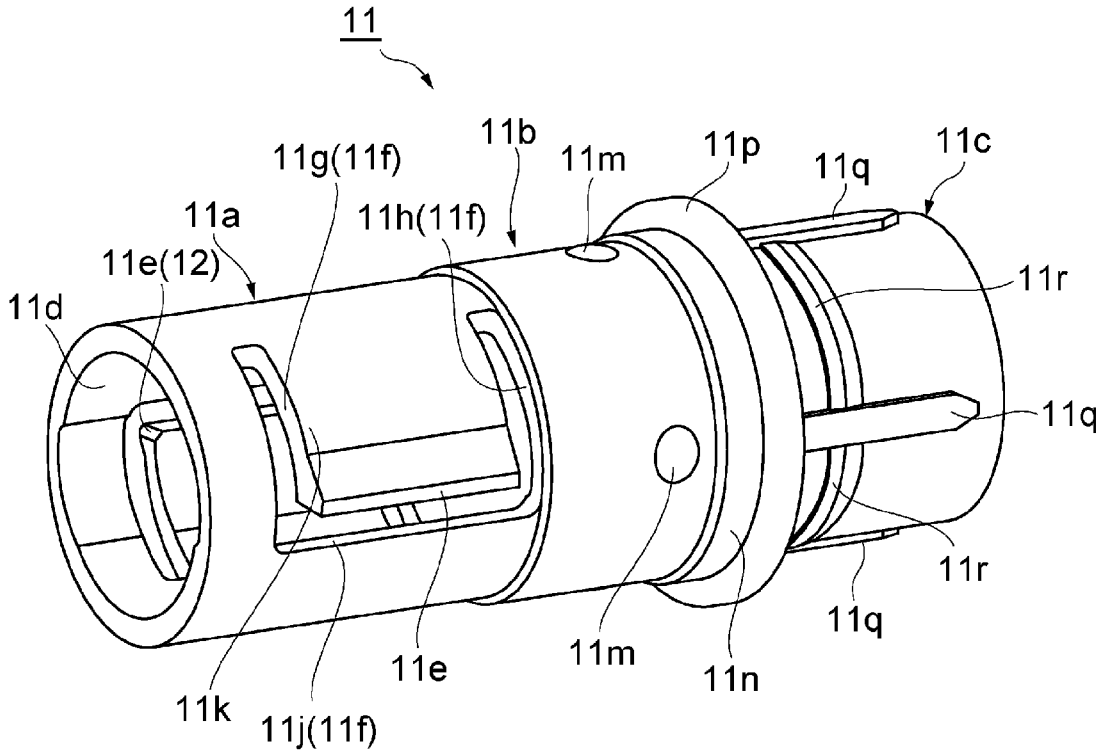
FIG. 8A is a perspective view of an inner tube.
Figure 8B:
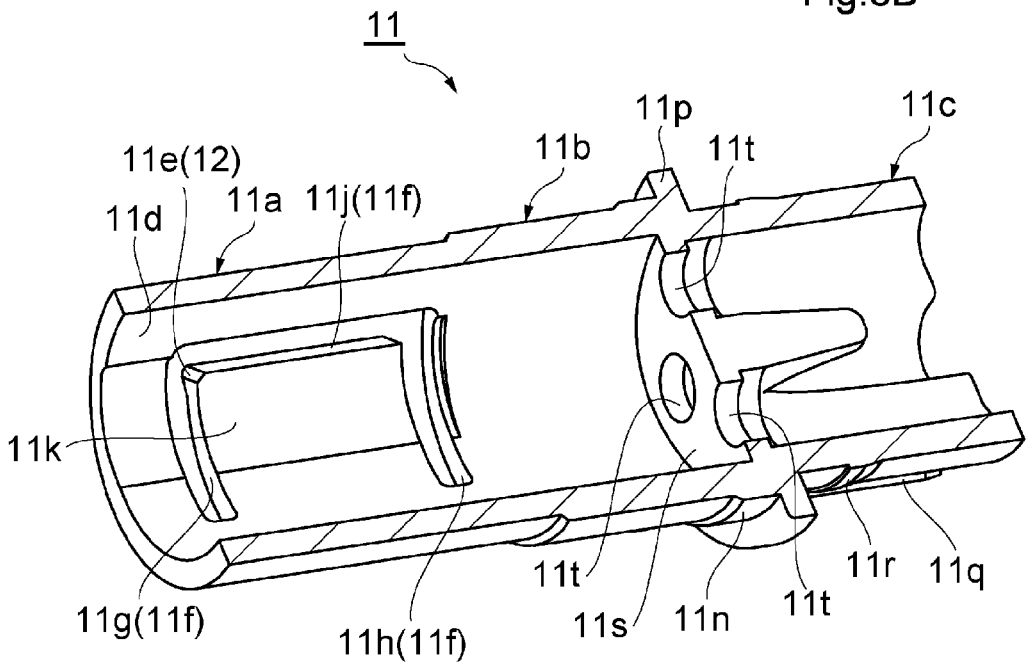
FIG. 8B is a cross-sectional perspective view of the inner tube.

FIG. 8A is an enlarged perspective view of the inner tube 11 of FIG. 6. FIG. 8B is an enlarged cross-sectional perspective view of the inner tube 11 of FIG. 6. The inner tube 11 is formed of polyacetal (POM) by means of injection molding and has an annular shape with steps in its appearance. The inner tube 11 includes a front end cylindrical portion 11*a*, a central cylindrical portion 11*b* whose diameter is larger than the diameter of the front end cylindrical portion 11*a*, and a rear end cylindrical portion 11*c* whose diameter is smaller than those of the front end cylindrical portion 11*a* and the central cylindrical portion 11*b*, in the order of the above-mentioned description from the front to the rear.

The front end cylindrical portion 11*a* includes protruding portions 11*e* that constitute the other of the ratchet mechanism 12 at a pair of positions facing with each other on the inner circumferential surface 11*d* thereof. The protruding portions 11*e* are engaged with the concave and convex portion 2*f* of the leading tube 2 in the rotational direction and provided in such a manner as to protrude on the outer side in the radial direction. C-shaped notches 11*f* communicated with the inside and outside of the inner tube 11 are formed in the periphery of the protruding portions 11*e* of the front end cylindrical portion 11*a*, and the notches 11*f* provide the protruding portions 11*e* with elasticity in the radial direction. The protruding portions 11*e* of the inner tube 11 are brought into close contact with the concave and convex portion 2*f* of the leading tube 2 at all times.

Figure 9:
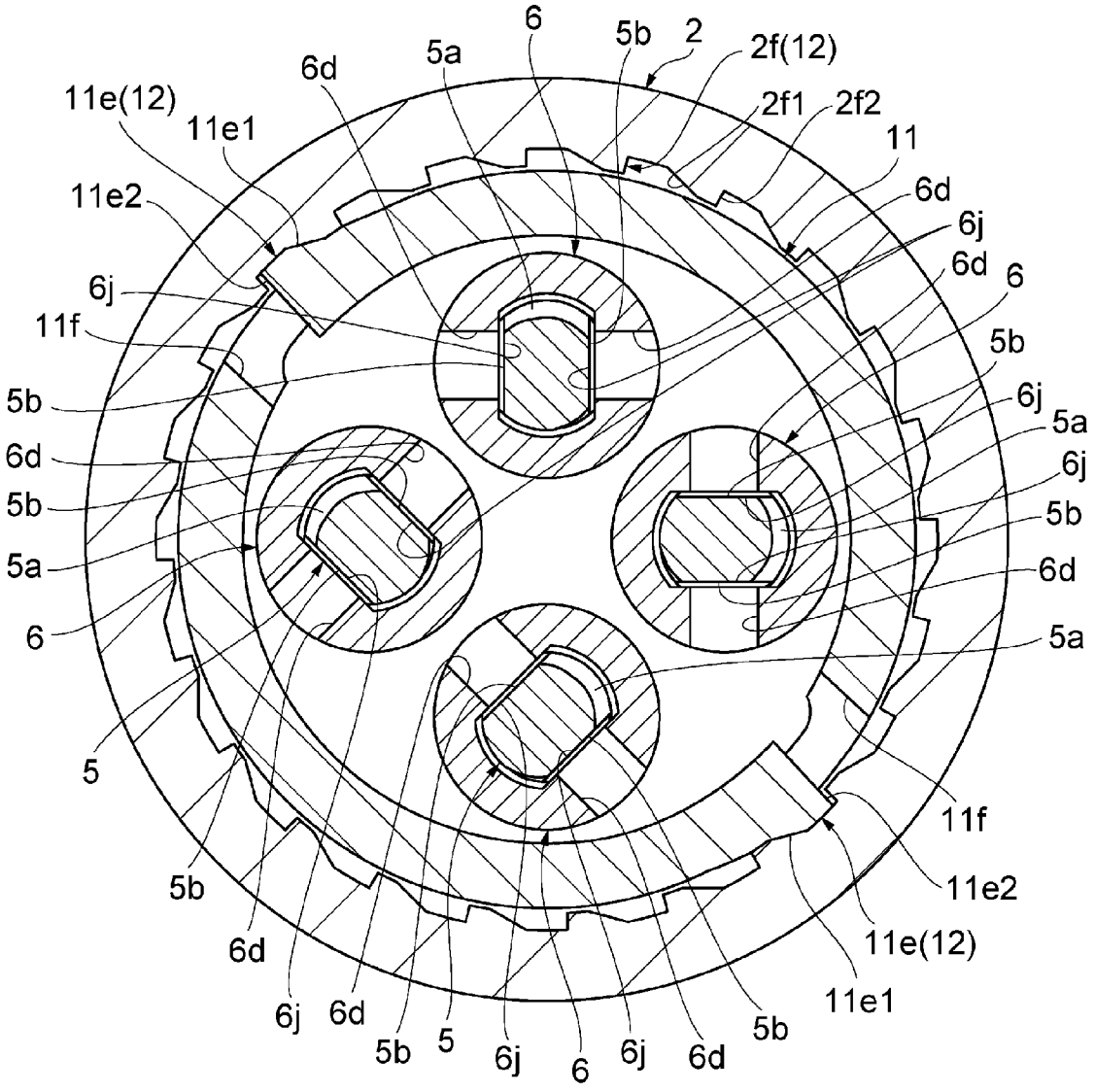
FIG. 9 is a cross-sectional view taken along a line A-A of FIG. 1.

FIG. 9 is a cross-sectional view taken along a line A-A of FIG. 1. As described in FIG. 9, the concave and convex portion 2*f* of the leading tube 2, which constitutes the one of the ratchet mechanism 12, includes inclined surfaces 2*f*1 and lateral surfaces 2*f*2. The inclined surfaces 2*f*1 incline with respect to the inner circumferential surface of the leading tube 2. The lateral surfaces 2*f*2 are formed in such a manner to be disposed approximately perpendicular to the inner circumferential surface of the leading tube 2. Also, the protruding portions 11*e* of the inner tube 11, which constitute the other of the ratchet mechanism 12, include inclined surfaces 11*e*1 and lateral surfaces 11*e*2. The inclined surface 11*e*1 inclines with respect to the outer circumferential surface of the inner tube 11. The lateral surfaces 11*e*2 is formed in such a manner to be disposed approximately perpendicular to the tangent of the outer circumferential surface of the inner tube 11.

As illustrated in FIG. 8, the notches 11*f* of the inner tube 11 include a pair of slits 11*g* and 11*h* that are drilled on bilateral sides of the protruding portions 11*e* of the front end cylindrical portion 11*a* in the axial direction and extended in the circumferential direction, and slits 11*j* that are drilled on one side of the protruding portions 11*e* of the front end cylindrical portion 11*a* in the circumferential direction and continuously extended in the axial direction with respect to the slits 11*g* and 11*h*. A wall portion surrounded by the notches 11*f* in the front end cylindrical portion 11*a* forms an arm 11*k* having flexibility in the radial direction. Accordingly, the protruding portions 11*e* disposed on the outer surface at the tip end portion of the arm 11*k* have elasticity (energized force) in the radial direction.

Protrusions 11*m* engaged with the annular concave portions 2*g* of the leading tube 2 and an annular convex portion 11*n* that is inserted into the annular concave portion 2*h* of the leading tube 2 from the rear are provided on the outer circumferential surface of the central cylindrical portion 11*b* of the inner tube 11. An annular collar portion 11*p* is provided in the rear portion of the annular convex portion 11*n* on the outer circumferential surface of the central cylindrical portion 11*b*, and the cylindrical portion on the front side with respect to the collar portion 11*p* serves as an insertion portion, which is inserted into the leading tube 2 from the rear.

Protrusions 11*q* engaged with the main body 3 in the rotational direction are formed on the rear end cylindrical portion 11*c* of the inner tube 11 in such a manner as to extend in the axial direction. The protrusions 11*q* are formed at positions equally divided by four in the circumferential direction on the outer circumferential surface of the rear end cylindrical portion 11*c*. Also, a convex portion 11*r* engaged with the main body 3 in the axial direction is formed on the rear side of the collar portion 11*p*, and the convex portion 11*r* extends in the circumferential direction between the protrusions 11*q*.

The inner tube 11 is partitioned into the left and right on the drawing by means of a holding member storage portion 11*s*, which is a disc-shaped portion that allows the four holding members 6 to penetrate in the axial direction, on the inner side of the collar portion 11*p*. Circular openings 11*t*, which allow the holding members 6 to penetrate in the axial direction, are provided in the holding member storage portion 11*s* at positions equally divided by four in the circumferential direction.

Regarding the inner tube 11, the front end cylindrical portion 11*a* and the central cylindrical portion 11*b* are inserted into the leading tube 2 from the rear side of the leading tube 2. In this time, the protruding portions 11*e* of the front end cylindrical portion 11*a* are engaged with the concave and convex portion 2*f* of the leading tube 2 in the rotational direction, and the protrusions 11*m* of the central cylindrical portion 11*b* are engaged with the annular concave portions 2*g* of the leading tube 2, and the annular convex portion 11*n* of the central cylindrical portion 11*b* is inserted into the annular concave portion 2*h* of the leading tube 2.

Figure 10:
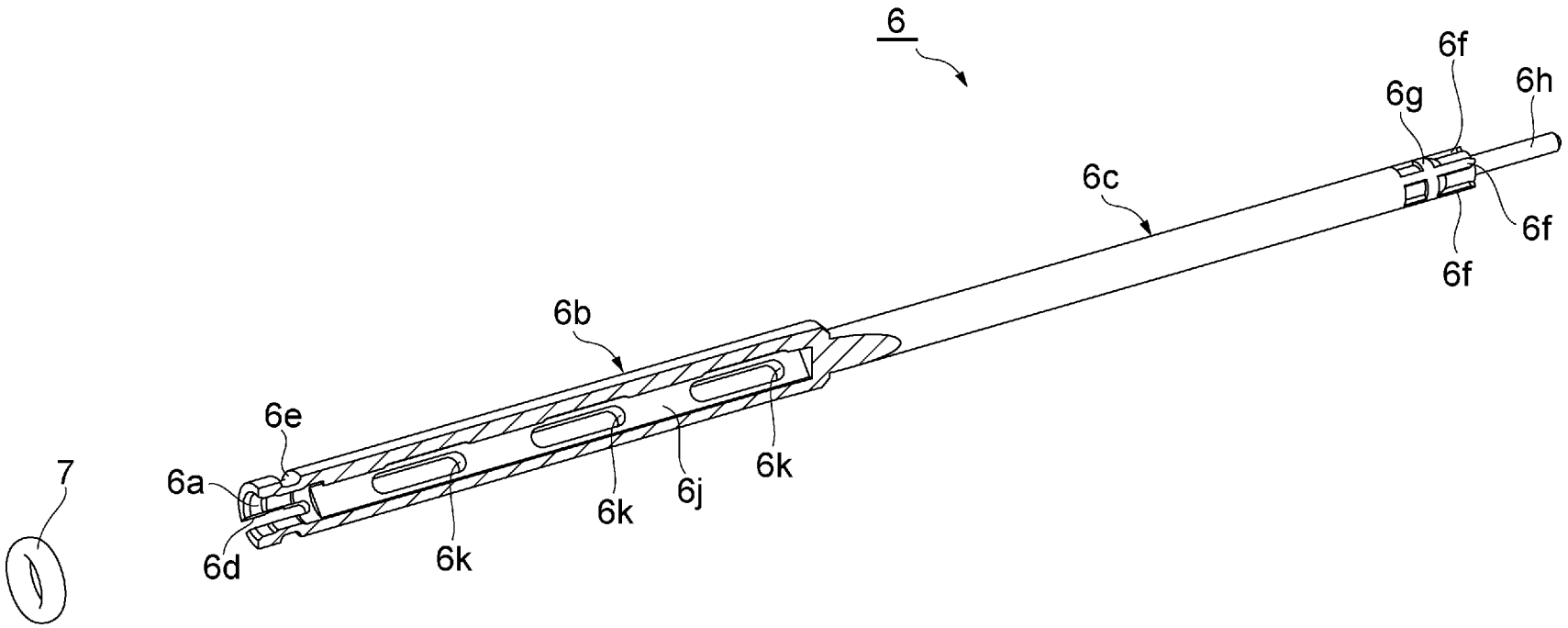
FIG. 10 is a partially cross-sectional perspective view of a holding member and a perspective view of an O-ring.

FIG. 10 is a partially cross-sectional perspective view illustrating the O-ring 7 and the holding member 6. The whole of the holding member 6 is formed in a rod shape in its appearance. For example, the POM is used as the material of the holding member 6. The holding member 6 includes an annular movable body holding portion 6*b* that includes a hole part 6*a* that is provided on the front side and stores the movable body 5, and a round-rod-shaped rod portion 6*c* extended in the axial direction in the rear portion of the movable body holding portion 6*b*.

The movable body holding portion 6*b* of the holding member 6 includes a pair of slits 6*d* that are extended by a predetermined length from the front end to the rear and formed in such a manner as to face with each other on the inner circumferential surface of the movable body holding portion 6*b*. The diameter of the front end of the movable body holding portion 6*b* can be expanded on the outer side in the radial direction by means of the slits 6*d*. An annular concave portion 6*e* into which the O-ring 7 is inserted is provided on the outer circumferential surface of a section in which the slits 6*d* of the movable body holding portion 6*b* are provided. The O-ring 7 is inserted into the annular concave portion 6*e*, whereby the movable body 5 held by the movable body holding portion 6*b* is tightened inward, which prevents the movable body 5 from coming off from the movable body holding portion 6*b*.

Plane portions 6*j* that synchronously rotate the movable body 5 are provided at a pair of positions facing with each other on the inner side of the movable body holding portion 6*b* of the holding member 6. When the movable body holding portion 6*b* is cut by the plane orthogonal to the axial direction, the cross section of the hole part 6*a* is formed in a non-circular shape by the plane portions 6*j*. Also, three oblong through holes 6*k* extended in the axial direction are provided in the plane portions 6*j*, in such a manner as to penetrate the holding member 6, in order to prevent a core pin from being inclined by the injection pressure at the time of molding and support the core pin. The rod portion 6*c* disposed in the rear of the movable body holding portion 6*b*, as constituted in the above-mentioned manner, is inserted into the opening 11*t* of the holding member storage portion 11*s* of the inner tube 11 in the axial direction.

Protrusions 6*f* engaged with the sliding parts 8 in the rotational direction are formed on the rear side of the rod portion 6*c* of the holding member 6 in such a manner as to extend in the axial direction, and the protrusions 6*f* are formed at positions equally divided by four in the circumferential direction on the outer circumferential surface of the rod portion 6*c*. Also, a convex portion 6*g* engaged with the sliding part 8 in the axial direction is formed on the rear side of the rod portion 6*c*, and the convex portion 6*g* extends in the circumferential direction between the protrusions 6*f*. Also, a rod-shaped projection 6*h*, which further protrudes backward in a state where its diameter is reduced from a section on which the protrusions 6*f* are provided, is provided on the rear end of the rod portion 6*c*. The projection 6*h* is used as a tool that facilitates ease of assembly on the sliding part 8 along with the spring 9.

Figure 11:
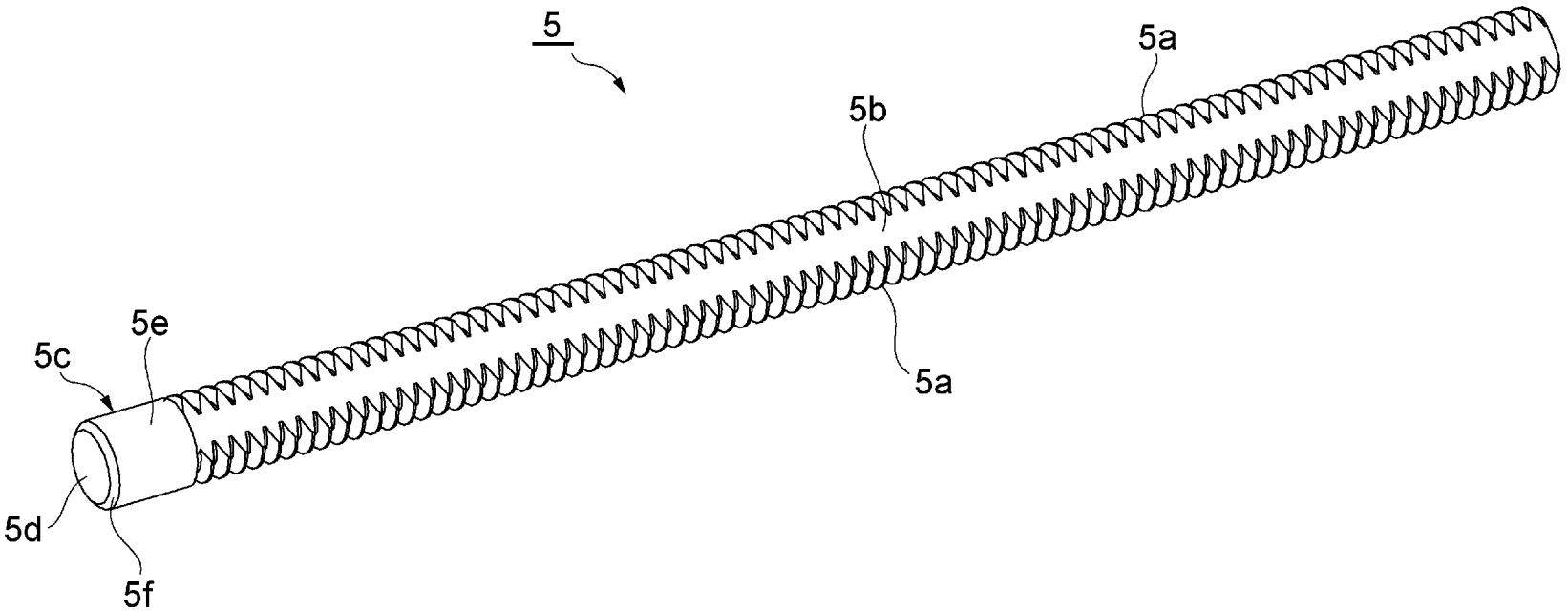
FIG. 11 is a perspective view of a movable body.

FIG. 11 is a perspective view of the movable body 5. The movable body 5 is formed in a rod shape in its appearance. For example, the POM is used as the material of the movable body 5. The movable body 5 includes male screws 5*a* and plane portions 5*b* that are pressed by the plane portions 6*j* of the holding member 6 (see FIG. 9) on the outer circumferential surface thereof. Regarding the plane portions 5*b*, when the male screws 5*a* and the plane portions 5*b* are cut by the plane orthogonal to the axial direction, their shapes are formed in a non-circular shape in accordance with the hole part 6*a* of the holding member 6.

The pitches of the male screws 5*a* of the movable body 5 (distances between the screw threads of the male screws 5*a* in the axial direction) are equal to or higher than 0.3 mm and equal to or lower than 1.0 mm, and are preferably equal to 0.4 mm. Conventionally, the pitches of the male screws are generally equal to or higher than 2.0 mm and equal to or lower than 6.0 mm. Accordingly, the pitches of the male screws 5*a* are infinitesimal pitches that are shorter than the pitches of the general male screws.

The plane portions 5*b* of the movable body 5 are provided in such a manner as to be extended in the axial direction in the section in which the male screws 5*a* are provided, and the plane portions 5*b* are provided at a pair of positions facing with each other on the outer circumferential surface of the movable body 5. The male screws 5*a* and the plane portions 5*b* of the movable body 5 are inserted into the movable body holding portion 6*b* from the front, with a clearance left between the plane portions 5*b* and the plane portions 6*j* of the movable body holding portion 6*b*. Then, the protrusions provided on the inner side of the movable body holding portion 6*b* and the male screws 5*a* of the movable body 5 are fitted, whereby the movable body 5 is held with respect to the movable body holding portion 6*b*. Also, an annular extruding portion 5*c* that extrudes the drawing material M forward in the pipe member 1 is provided at the front end of the movable body 5. The extruding portion 5*c* includes a flat bottom surface 5*d* positioned at the front end thereof, a lateral surface 5*e* extended in the circumferential direction, and a tapered surface 5*f* that inclines with respect to the bottom surface 5*d* and is continuously abutted with the bottom surface 5*d* and the lateral surface 5*e*. The flat bottom surface 5*d* of the extruding portion 5*c* is a surface that extrudes the drawing material M forward.

Figure 12:
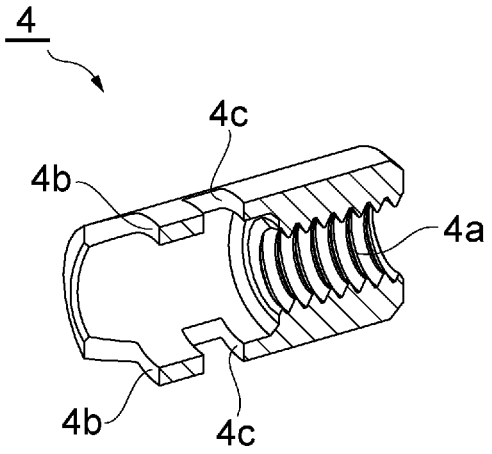
FIG. 12 is a cross-sectional perspective view of a screw tube.

FIG. 12 is a cross-sectional perspective view of the screw tube 4. The screw tube 4 is formed in an approximately cylindrical shape. For example, the POM is used as the material of the screw tube 4. Female screws 4*a* that allow the movable body 5 to transfer are formed on the rear side on the inner circumferential surface of the screw tube 4. As is the same with the male screws 5*a* of the movable body 5, the pitches of the female screws 4*a* of the screw tube 4 (distances between the screw threads of the female screws 4*a* in the axial direction) are infinitesimal pitches that are shorter than the pitches of the general female screws. Also, concave portions 4*b* engaged with the rear end of the pipe member 1 at the front end of the screw tube 4 are provided on the front side of the screw tube 4, and the concave portions 4*b* are formed in a trapezoidal shape in which the front end of the screw tube 4 is notched by a predetermined length backward. The concave portions 4*b* are provided at a pair of positions facing with each other on the inner circumferential surface of the screw tube 4.

Hole parts 4*c* engaged with the rear end of the pipe member 1 are provided in the rear of the concave portions 4*b* of the screw tube 4, and the hole parts 4*c* are provided in such a manner as to penetrate the screw tube 4. The hole parts 4*c* are formed in a shape extended in the circumferential direction and provided at a pair of positions facing with each other on the inner circumferential surface of the screw tube 4.

Figure 13:
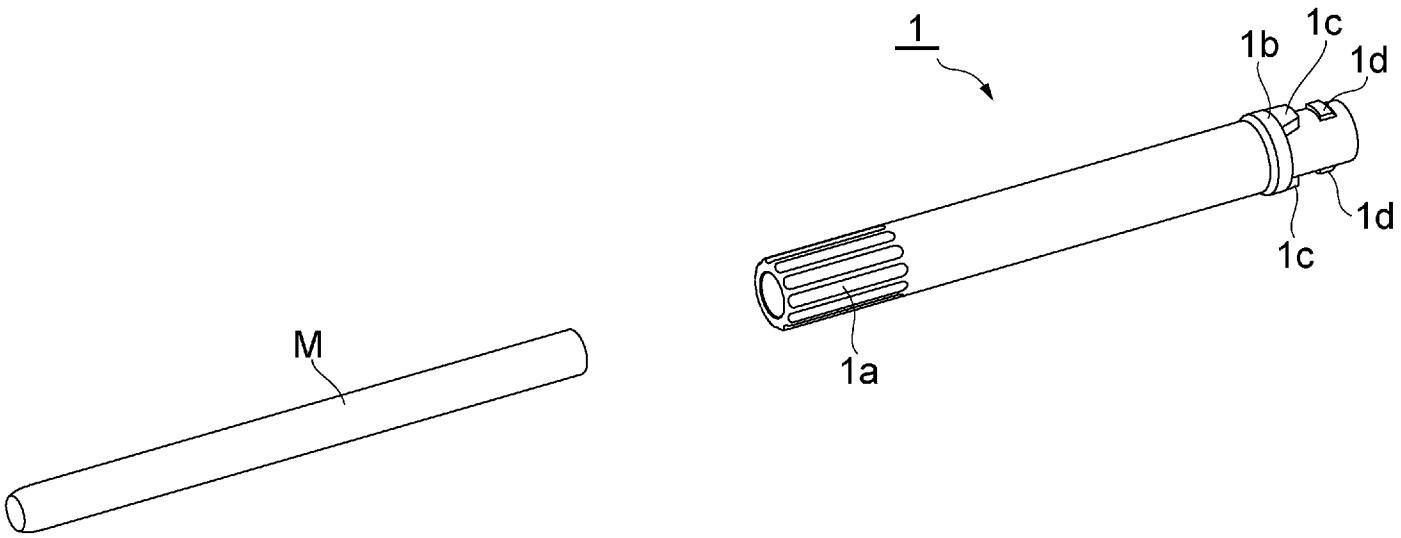
FIG. 13 is a perspective view of a pipe member and a drawing material.

FIG. 13 is a perspective view of the pipe member 1 and the drawing material M. The pipe member 1 is formed in an approximately cylindrical shape. For example, polypropylene (PP) is used as the material of the pipe member 1. The pipe member 1 may be colored with the same color as that of the drawing material M or formed of transparent materials, which makes it possible to discriminate the color of the drawing material M in an easy manner. The inner surface (the area on which the drawing material M is loaded) of the pipe member 1 is formed in a flat shape having no step, so that the drawing material M can be easily loaded by suction over the whole of the inner surface of the pipe member 1. A multitude of concave portions are disposed in parallel at the front end portion on the outer circumferential surface of the pipe member 1 in the circumferential direction, as portions engaged with the protrusions 2*e* of the leading tube 2 in the rotational direction, and oblong concave grooves 1*a* formed by the concave portions extended by a predetermined length in the axial direction are provided.

An annular collar portion 1*b*, projections 1*c* engaged with the concave portion 4*b* of the screw tube 4 in the rear portion of the collar portion 1*b*, and protrusions 1*d* fitted into the hole part 4*c* of the screw tube 4 in the rear of the projections 1*c* are provided on the rear side on the outer circumferential surface of the pipe member 1. Accordingly, this allows the pipe member 1 and the screw tube 4 to engage each other in the axial direction and rotate in synchronism with each other. The height of the collar portion 1*b* with respect to the outer circumferential surface of the pipe member 1, the height of the projections 1*c* with respect to the outer circumferential surface of the pipe member 1, and the height of the screw tube 4 engaged with respect to the outer circumferential surface are approximately the same.

The projections 1*c* of the pipe member 1 are formed in a trapezoidal shape extended from the collar portion 1*b* of the pipe member 1 by a predetermined length backward. The projections 1*c* are provided at a pair of positions facing with each other on the outer circumferential surface of the pipe member 1. The protrusions 1*d* of the pipe member 1 are formed in a shape extended in the circumferential direction and provided at a pair of positions facing with each other on the outer circumferential surface of the pipe member 1. The pipe member 1 constituted in the above-mentioned manner is engaged with the screw tube 4 from the rear. In this time, the projections 1*c* of the pipe member 1 are fitted into the concave portion 4*b* of the screw tube 4, and the protrusions 1*d* of the pipe member 1 are fitted with the hole part 4*c* of the screw tube 4 from the inner side of the screw tube 4.

Figure 14:
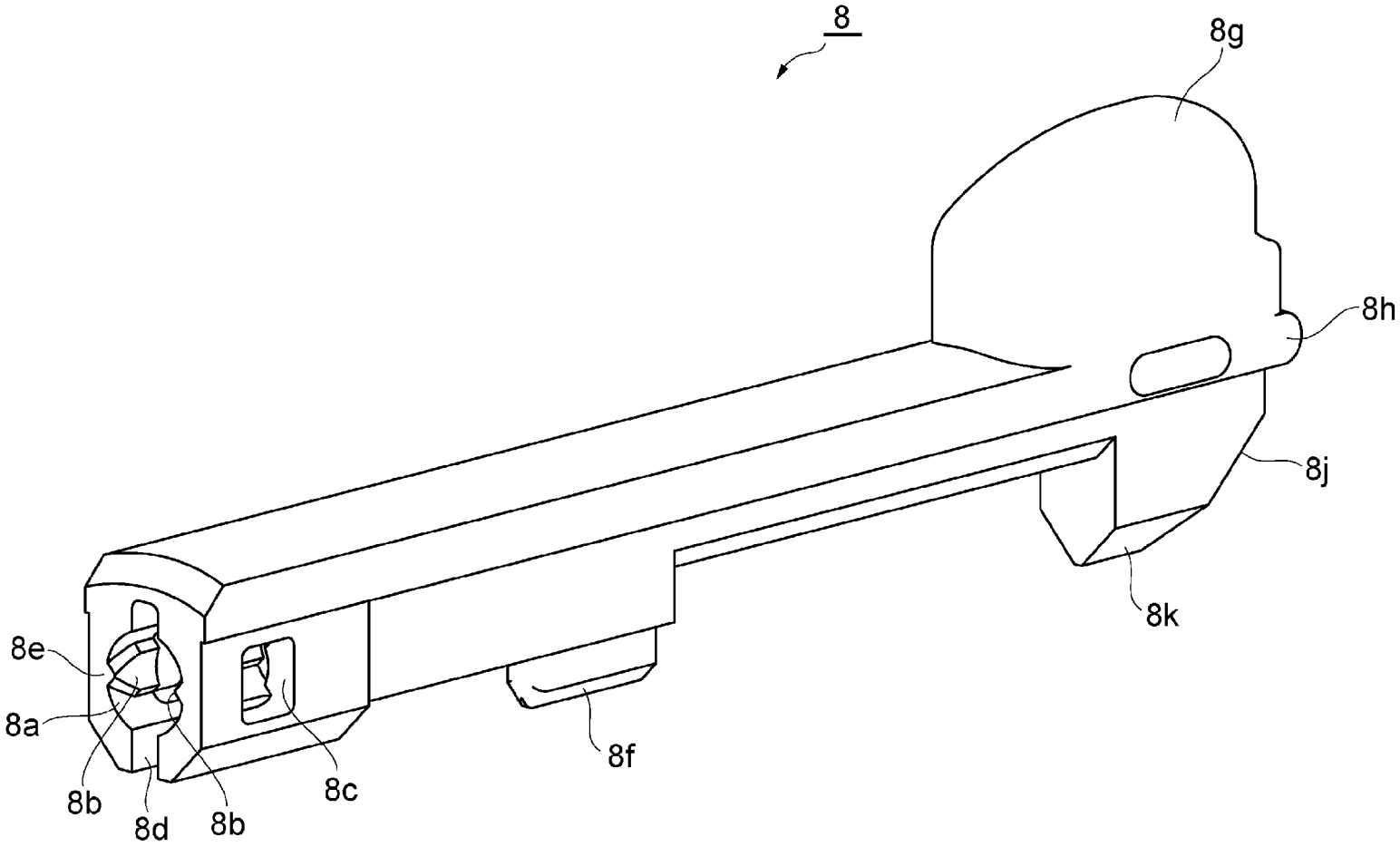
FIG. 14 is a perspective view of the sliding part.

FIG. 14 is a perspective view of the sliding part 8. For example, acrylonitrile butadiene styrene (ABS) resin is used as the material of the sliding part 8. The color of the sliding part 8, for example, is the same color as that of the corresponding drawing material M. The sliding part 8 of a desired color is slid forward by a given distance, which makes it possible to expose the drawing material M of a desired color from the opening portion 2*a* of the leading tube 2 to the front.

The sliding part 8 is formed in a shape extended in the axial direction. A hole part 8*a* in which the projection 6*h* of the holding member 6 is inserted from the front is provided on the front side of the sliding part 8. Projections 8*b* and window portions 8*c*, which are engaged with the convex portion 6*g* of the holding member 6 in the axial direction and engaged with the protrusions 6*f* of the holding member 6 in the rotational direction, are provided in the hole part 8*a*. A notch 8*d* extended in the axial direction is provided in the hole part 8*a* in such a manner as to communicate. Also, a flat surface 8*e* abutted with one end of the spring 9 is provided at the front end of the sliding part 8.

A projection 8*f* that returns another sliding part 8 to the rear is provided in the rear of the window portion 8*c* of the sliding part 8, and the projection 8*f* protrudes on the inner side of the main body 3 and extends in the axial direction. A projection 8*g* that protrudes on the outer side of the main body 3, a rear end portion 8*h* that protrudes at the rear end of the sliding part 8 backward and is hooked on the main body 3, and a projection 8*k* that includes an inclined surface 8*j* that protrudes on the inner side of the main body 3 and is abutted with the projection 8*f* of another sliding part 8 are provided at the rear end of the sliding part 8.

The sliding part 8 constituted in the above-mentioned manner is engaged with the holding member 6 from the front thereof. In this time, the projection 6*h* of the holding member 6 is inserted in the hole part 8*a* of the sliding part 8, and the convex portion 6*g* of the holding member 6 climbs over the projection 8*b* of the sliding part 8, and the protrusions 6*f* and the convex portion 6*g* are engaged with the projection 8*b* and the window portions 8*c*, whereby the holding member 6 is synchronously rotatably engaged with the front side of the sliding part 8.

Figure 15A:
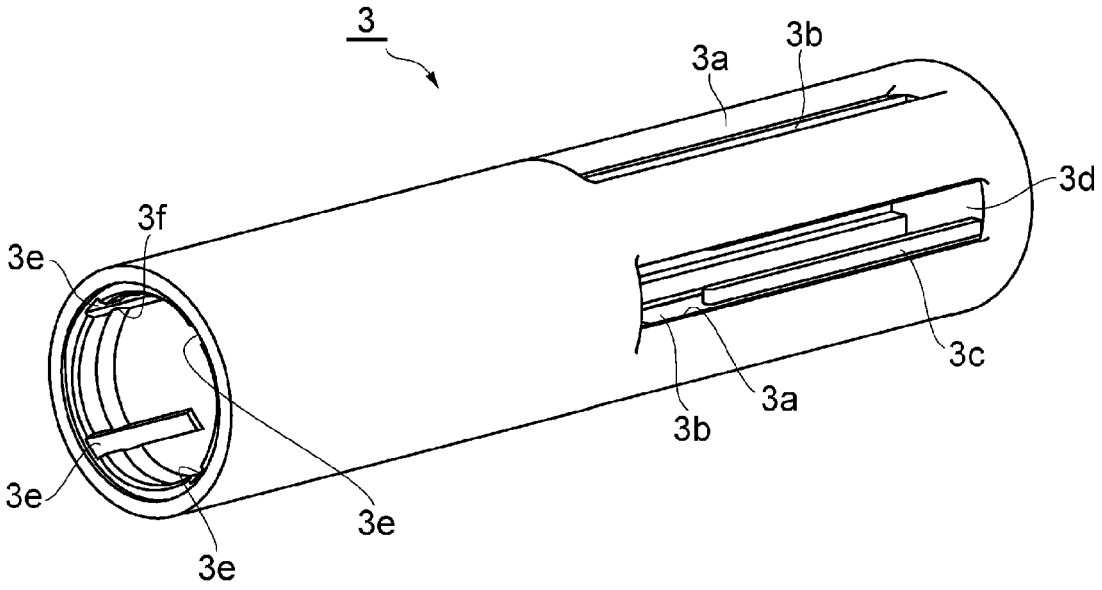
FIG. 15A is a perspective view of the main body.
Figure 15B:
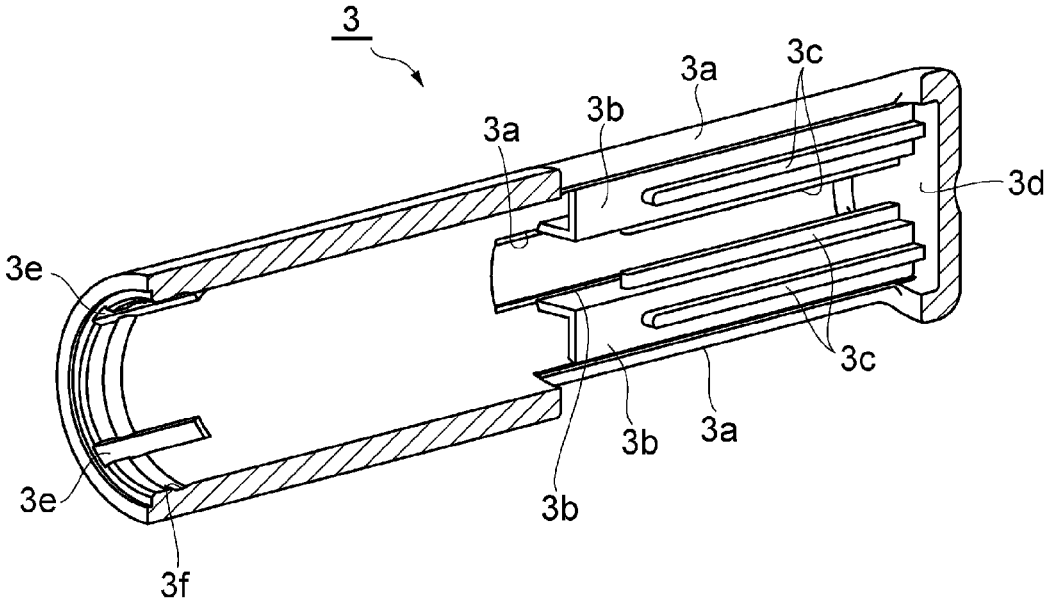
FIG. 15B is a cross-sectional perspective view of the main body.

FIG. 15A is a perspective view of the main body 3. FIG. 15B is a cross-sectional perspective view of the main body 3. The main body 3 is formed of the ABS resin by means of injection molding and has a bottomed cylindrical shape. Notch portions 3*a* that extend in the axial direction and allow the projection 8*g* of the sliding part 8 to protrude outward are provided on the rear side of the main body 3, and the notch portions 3*a* are provided at positions equally divided by four in the circumferential direction.

Flat portions 3*b* extended on the inner side from the notch portions 3*a* and projections 3*c* extended in the axial direction on the rear side of the flat portions 3*b* are provided on the inner side of the notch portions 3*a* of the main body 3. The rear side of the projections 3*c* extends to the bottom surface 3*d* of the main body 3. When the projection 8*g* of the sliding part 8 is moved forward along with the notch portions 3*a* of the main body 3, the rear end portion 8*h* of the sliding part 8 advances along with the projections 3*c*. When the rear end portion 8*h* reaches the front end of the projections 3*c*, the sliding part 8 enters the inner side of the notch portions 3*a*, and the rear end portion 8*h* is hooked at the front end of the projections 3*c*. Also, in a state where the rear end portion 8*h* of one sliding part 8 (for example, the sliding part 8A in FIG. 4) is hooked on the front end of the projections 3*c*, the inclined surface 8*j* of one sliding part 8 is disposed close to the projection 8*f* of another sliding part 8 (for example, the sliding part 8B, 8C, or 8D in FIG. 4).

Concave grooves 3*e* engaged with the protrusions 11*q* of the inner tube 11 in the rotational direction and annular concave portions 3*f* engaged with the convex portion 11*r* of the inner tube 11 in the axial direction are provided on the front side on the inner circumferential surface of the main body 3. The concave grooves 3*e* are formed in such a manner as to extend by a predetermined length backward from the front end of the main body 3 and disposed at positions equally divided by four in the circumferential direction on the inner circumferential surface of the main body 3. Also, the annular concave portions 3*f* extend in the circumferential direction between the concave grooves 3*e*.

The four sliding parts 8 are inserted into the main body 3 from the front side thereof, and the projection 8*g* of the sliding part 8 is brought into a state of being protruded to the outside from the notch portion 3*a*. Also, the inner tube 11 enters the front end of the main body 3. In this configuration, the protrusions 11*q* of the inner tube 11 enter the concave grooves 3*e* of the main body 3, and the convex portion 11*r* of the inner tube 11 enters the annular concave portions 3*f* of the main body 3, whereby the inner tube 11 is synchronously rotatably engaged with the main body 3.

As illustrated in FIGS. 3 and 4, the spring 9 is wound around the outer diameter of the rod portion 6*c* of the holding member 6 with a clearance left therebetween. One end (front end) of the spring 9 is abutted with the rear wall of the holding member storage portion 11*s* of the inner tube 11, and the other end (rear end) of the spring 9 is abutted with the flat surface 8*e* positioned at the front end of the sliding part 8. The sliding part 8 is brought into a state of being energized backward by means of the spring 9.

Hereinafter, the operation of the multi pencil 100 constituted in the above-mentioned manner during use will be described. Regarding the multi pencil 100 in an initial state illustrated in FIG. 3, the four sliding parts 8 are brought into a state of being positioned at the rear end of the notch portions 3*a* of the main body 3, and the four pipe members 1 are positioned on the inner side of the leading tube 2. In this state, when the sliding part 8A is moved forward by a predetermined distance along the notch portion 3*a*, as illustrated in FIG. 4, the holding member 6A, the screw tube 4A, the pipe member 1A, and the drawing material M1, which are engaged with the sliding part 8A in the axial direction, are moved forward, and the drawing material M1 is exposed forward from the opening portion 2*a* of the leading tube 2.

In this time, the front-side portion of the pipe member 1A enters the inner circumferential surface 2*d* of the leading tube 2, whereby the holding member 6A is bent in such a manner as to incline with respect to the axial direction, and the concave groove 1*a* of the pipe member 1 is engaged with the protrusions 2*e* of the leading tube 2 in the rotational direction. Then, the rear end portion 8*h* of the sliding part 8A is brought into a state of being hooked on the front end of the projections 3*c* of the main body 3.

In this state, for example, when a user relatively rotates the main body 3 in one direction (for example, clockwise) with respect to the leading tube 2, the inner tube 11, the four sliding parts 8, the four holding members 6, the four movable bodies 5 start rotating in the one direction. Herein, the pipe members 1B to 1D in which the concave grooves 1*a* are not engaged with the protrusions 2*e* of the leading tube 2, and the screw tubes 4B to 4D are rotated in the one direction in response to the relative rotation.

In contrast, the holding member 6A coupled with the pipe member 1A, in which the concave grooves 1*a* are engaged with the protrusions 2*e* of the leading tube 2, via the screw tube 4A, is bent in the one direction in response to the relative rotation and starts rotating in the one direction while being elastically deformed. Also, the pipe member 1A, in which the concave grooves 1*a* are engaged with the protrusions 2*e* of the leading tube 2, and the screw tube 4A do not rotate in the one direction in accordance with the rotation of the movable body 5A, and the movable body 5A relatively rotates with respect to the pipe member 1A and the screw tube 4A. Accordingly, the action of screw-threaded engagement between the male screw 5*a* of the movable body 5 and the female screw 4*a* of the screw tube 4 is exerted in response to the relative rotation in the one direction, and the movable body 5A starts advancing with respect to the pipe member 1A and the screw tube 4A. Then, the bottom surface 5*d* of the extruding portion 5*c* of the movable body 5A presses forward the drawing material M1 loaded in the pipe member 1A, whereby the movable body 5A and the drawing material M1 start advancing with respect to the pipe member 1A together.

Also, as illustrated in FIG. 9, during the relative rotation in the one direction, the protruding portions 11*e* of the inner tube 11 constituting the ratchet mechanism 12 are engaged with the concave and convex portion 2*f* of the leading tube 2 in the rotational direction, and the protruding portions 11*e* are energized in the radial direction by the elastic force of the notches 11*f*, so that engagement and release of engagement (mesh and release of mesh) between the protruding portions 11*e* and the concave and convex 2*f* are repeated. That is, when the relative rotation in the one direction is performed in a state where the protruding portions 11*e* and the concave and convex 2*f* are engaged in the rotational direction, the inclined surfaces 11*e*1 of the protruding portions 11*e* are abutted with the inclined surfaces 2*f*1 of the concave and convex portion 2*f*, and in this state, the inclined surfaces 11*e*1 are slid in such a manner as to climb up the inclined surfaces 2*f*1.

Then, after the protruding portions 11*e* climb over the convex portion of the concave and convex portion 2*f*, the protruding portions 11*e* and the concave and convex portion 2*f* are engaged in the rotational direction again. As a result, every time the protruding portions 11*e* and the concave and convex portion 2*f* are engaged and released, a sense of clicking is provided for a user. Note that, 24 projections and depressions are disposed side by side in the circumferential direction in the concave and convex portion 2*f*, so that a sense of clicking is provided for the user for every relative rotation of 15 degrees in one direction.

On the other hand, when the user tries to relatively rotate the main body 3 with respect to the leading tube 2 in the other direction (for example, counterclockwise), which is the direction opposite to the above-mentioned one direction, the lateral surfaces 11*e*2 of the protruding portions 11*e* constituting the ratchet mechanism 12 are abutted with lateral surfaces 2*f*2 of the concave and convex portion 2*f*, and the relative rotation in the other direction is regulated. Accordingly, the leading tube 2 and the main body 3 are not relatively rotated in the other direction. That is, the turning force (torque) of the relative rotation in the one direction is set to a force that can be easily rotated by the user, and the turning force of the relative rotation in the other direction is set to a force that cannot be easily rotated by the user. For example, when the outer diameter of the main body 3 is designed to correspond to approximately 14 mm, it is preferable that the torque of the relative rotation in the one direction be set to 0.1 N·m (newton meter) or lower, and the torque of the relative rotation in the other direction be set to 0.2 N·m or higher.

Also, as illustrated in FIG. 4, in a state where the pipe member 1A is moved forward by means of the forward movement of the sliding part 8A, and the drawing material M1 is exposed forward, when any of the sliding parts 8B to 8D (hereinafter referred to as another sliding part 8) is moved forward by a constant distance, the projection 8*f* of another sliding part 8, which is closely disposed on the inclined surface 8*j* of the sliding part 8A, is abutted with the inclined surface 8*j*. When the projection 8*f* of another sliding part 8 is abutted with the inclined surface 8*j* of the sliding part 8A, the sliding part 8A is pushed out to the outer side of the main body 3, and connection between the rear end portion 8*h* of the sliding part 8A and the front end of the projections 3*c* is released. Accordingly, the sliding part 8A is returned to the position of the rear end of the notch portion 3*a* by the backward energizing force of the spring 9A.

As described above, regarding the multi pencil 100, the drawing materials M are each coupled with the four sliding parts 8, and one arbitrary sliding part 8A moves forward by a constant distance with respect to the main body 3, whereby the drawing material M1 coupled with the sliding part 8A is exposed from the leading tube 2. Then, in this state, the leading tube 2 and the main body 3 are relatively rotated in one direction, whereby the drawing material M1 is configured to move forward, and furthermore, the drawing material M1 is regulated only in such a manner as to move forward.

Thus, it is configured that it only needs to consider the thrust of the drawing material M to the front side by means of the relative rotation in the one direction. Accordingly, this eliminates the constitution in which the drawing material M is moved backward while being held, so that the drawing material M, which is made of soft materials that are difficult to hold, can be applied to the multi pencil 100. Also, regarding the multi pencil 100, the drawing material M is not moved backward with respect to the pipe member 1, so that there is no problem in that the drawing material M needs to be additionally moved forward in the next round of use. Consequently, the usability can be improved.

In the multi pencil 100 of the present embodiment, the ratchet mechanism 12 that allows only the relative rotation of the leading tube 2 and the main body 3 in one direction is provided. Also, the multi pencil 100 includes the inner tube 11 positioned on the front side of the main body 3, and the ratchet mechanism 12 is constituted by the protruding portions 11*e* that protrude from the outer surface of the inner tube 11 and have elasticity in the radial direction, and the concave and convex portion 2*f* that are provided on the inner surface of the leading tube 2 and rotatably engaged with the protruding portions 11*e*. Thus, the protruding portions 11*e* that protrude from the outer surface of the inner tube 11 and the concave and convex portion 2*f* that are provided on the inner surface of the leading tube 2 can be utilized as the ratchet mechanism 12.

Also, the protruding portions 11*e* of the inner tube 11 are normally closely disposed with the concave and convex portion 2*f* of the leading tube 2, so that resistance can be generated at all times between the outer surface of the inner tube 11 and the inner surface of the leading tube 2, and unsteadiness between the inner tube 11 and the leading tube 2 can be restrained.

Also, the male screws 5*a* formed on the outer circumference of the movable body 5 have infinitesimal pitches, so that the shifting amount of the movable body 5 by means of the relative rotation in one direction is also infinitesimal. Accordingly, the fine adjustment of the drawing material M that is thrust forward can be made, thereby preventing the malfunction that the drawing material M, which is erroneously thrust out to a large extent, is snapped, so that the usability can further be improved.

Also, the front end of the movable body 5 is formed in a cylindrical shape having the flat bottom surface 5*d*, and the bottom surface 5*d* thrusts the drawing material M from the rear, which allows the drawing material M to move forward. Accordingly, this eliminates the structure as seen in the core chuck that holds the drawing material M, so that the drawing material M is configured to be thrust out by the bottom surface 5*d* of the front end of the cylindrical movable body 5.

Also, the holding member 6 includes the hole part 6*a* formed in a non-circular shape in accordance with the cross-sectional shape of the movable body 5, and the movable body 5, whose cross section is formed in a non-circular shape, is inserted into the hole part 6*a* formed in a non-circular shape. Accordingly, this allows the engagement of the movable body 5 with the holding member 6 in the rotational direction, so that the holding member 6 can function as a rotational stop for the movable body 5.

Also, the holding member 6 includes the O-ring 7 that provides the movable body 5 inserted in the hole part 6*a* with an elastic force from the outer side. Accordingly, the movable body 5 in the hole part 6*a* can be held by the elastic force of the O-ring 7 from the outer side, so that the movable body 5 can be mounted on the holding member 6 by the application of the elastic force, and the movable body 5 can be detached from the holding member 6 by appropriately setting the elastic force. Consequently, the movable body 5 (cartridge 10) can be mounted on and detached from the holding member 6 in an easy manner.

The embodiment of the present invention has been described above, but the present invention is not limited to the above-mentioned embodiment. The present invention can be modified within the scope of the gist described in Claims, and another form may be applied. That is, the constitution and shape of each component constituting the multi pencil 100 may be appropriately changed or modified within the scope in which the gist is not changed.

For example, in the present embodiment, the relative rotation of the leading tube 2 and the main body 3 in the other direction is regulated by the ratchet mechanism 12. However, another form may be applied, wherein the arrangement or shape of the protruding portions or the concave and convex portion constituting the ratchet mechanism is appropriately changed. Also, for example, in place of the ratchet mechanism 12, it is possible to adopt a mechanism in which the action of the threaded engagement of screw portions is utilized, a mechanism in which a frictional force is utilized, or a mechanism in which an elastic force is utilized. Furthermore, a constitution may be applied wherein the drawing material M is fed by the relative rotation in one direction, and the relative rotation in the other direction is not fed by means of a clutch mechanism (running idle) that releases the action of the threaded engagement. In short, only the forward movement of the drawing material M needs to be regulated by the relative rotation of the leading tube 2 and the main body 3 in one direction.

Also, in the present embodiment, the O-ring 7 that tightens the movable body 5 inward is provided, but the O-ring 7 may be omitted. For example, in place of the O-ring 7, the movable body 5 may be tightened inward by the elastic force of resin in the movable body holding portion.

Also, in the present embodiment, the holding member 6 includes the annular movable body holding portion 6*b* positioned on the front side thereof and the rod portion 6*c* positioned on the rear side thereof. However, the movable body holding portion and the rod portion may be separately formed. Then, for example, a fitting structure in which the movable body holding portion and the rod portion are synchronously rotatably fitted with each other may be provided.

Also, in the present embodiment, the pipe member 1 and the screw tube 4 are separately provided, but the pipe member and the screw tube may be integrally provided. Furthermore, the holding member 6 and the sliding part 8 are separately provided. However, for example, the rod portion 6*c* of the holding member 6 and the sliding part 8 can be integrated.

Also, in the present embodiment, the multi pencil 100 that includes the drawing materials M1 to M4 each having a different color has been described. However, the multi pencil may include drawing materials each having a different thickness, or furthermore, the multi pencil may include drawing materials each made up of a different material. Also, the number of drawing materials is not limited to four, but two, three, or five or more drawing materials may be provided. In short, the present invention can be applied as long as the multi pencil includes a plurality of drawing materials.

What is claimed is:

1. A multi pencil comprising:

a cylindrical main body;

a cylindrical leading tube configured to be engaged with the main body;

a plurality of sliding parts configured to be each coupled with a drawing material held in an interior of the leading tube and configured to be slidably provided by a constant distance with respect to the main body, and a ratchet mechanism configured to allow a first relative rotation of the leading tube and the main body in one direction and regulate a second relative rotation of the leading tube and the main body in other direction, which is opposite to the one direction, wherein one arbitrary sliding part, out of the plurality of sliding parts, moves forward by a constant distance with respect to the main body, whereby the drawing material coupled with the one arbitrary sliding part is exposed from the leading tube, and in this state, the leading tube and the main body are relatively rotated in the one direction, which allows the drawing material to move forward, wherein only a forward movement of the drawing material is regulated by relative rotation of the leading tube and the main body in the one direction.

2. The multi pencil according to claim 1 further comprising an inner tube configured to be positioned at a front portion of the main body, wherein the ratchet mechanism includes protruding portions that protrude from an outer surface of the inner tube and have elasticity in a radial direction, and concave and convex portion that is provided on an inner surface of the leading tube and rotatably engaged with the protruding portions.

3. The multi pencil according to claim 2 further comprising a pipe member configured to be positioned in an interior of the leading tube, the pipe member in which the drawing material is loaded;

a movable body configured to extend in an axial direction on a rear portion of the drawing material and configured to include a male screw having infinitesimal pitches on an outer circumference; and a screw tube configured to be synchronously rotatably engaged with a rear side of the pipe member and configured to include a female screw that is threadedly engaged with the male screw on an inner circumference, wherein the sliding part moves forward by a constant distance with respect to the main body, which allows the pipe member to move forward and engage the leading tube in a rotational direction, and wherein, in this state, the leading tube and the main body are relatively rotated in the one direction, whereby the movable body moves forward with the drawing material by action of a screw-threaded engagement between the male screw and the female screw.

4. The multi pencil according to claim 3, wherein a front end of the movable body is formed in a cylindrical shape having a flat bottom surface, and wherein the bottom surface thrusts the drawing material forward, which allows the drawing material to move forward.

5. The multi pencil according to claim 4 further comprising a holding member configured to be arranged on a rear portion of the screw tube and hold the movable body inside, wherein a cross section of the movable body is formed in a non-circular shape, and wherein the holding member includes a hole part formed in a non-circular shape in accordance with a cross-sectional shape of the movable body.

6. The multi pencil according to claim 5, wherein the holding member includes an elastic portion configured to provide the movable body inserted in the hole part with an elastic force from an outer side.

7. The multi pencil according to claim 3 further comprising a holding member configured to be arranged on a rear portion of the screw tube and hold the movable body inside, wherein a cross section of the movable body is formed in a non-circular shape, and wherein the holding member includes a hole part formed in a non-circular shape in accordance with a cross-sectional shape of the movable body.

8. The multi pencil according to claim 7, wherein the holding member includes an elastic portion configured to provide the movable body inserted in the hole part with an elastic force from an outer side.

9. The multi pencil according to claim 2, wherein the protruding portions of the inner tube are abutted with the concave and convex portion of the leading tube at all times.

10. The multi pencil according to claim 9 further comprising a pipe member configured to be positioned in an interior of the leading tube, the pipe member in which the drawing material is loaded;

a movable body configured to extend in an axial direction on a rear portion of the drawing material and configured to include a male screw having infinitesimal pitches on an outer circumference; and a screw tube configured to be synchronously rotatably engaged with a rear side of the pipe member and configured to include a female screw that is threadedly engaged with the male screw on an inner circumference, wherein the sliding part moves forward by a constant distance with respect to the main body, which allows the pipe member to move forward and engage the leading tube in a rotational direction, and wherein, in this state, the leading tube and the main body are relatively rotated in the one direction, whereby the movable body moves forward with the drawing material by action of a screw-threaded engagement between the male screw and the female screw.

11. The multi pencil according to claim 10, wherein a front end of the movable body is formed in a cylindrical shape having a flat bottom surface, and wherein the bottom surface thrusts the drawing material forward, which allows the drawing material to move forward.

12. The multi pencil according to claim 11 further comprising a holding member configured to be arranged on a rear portion of the screw tube and hold the movable body inside, wherein a cross section of the movable body is formed in a non-circular shape, and wherein the holding member includes a hole part formed in a non-circular shape in accordance with a cross-sectional shape of the movable body.

13. The multi pencil according to claim 12, wherein the holding member includes an elastic portion configured to provide the movable body inserted in the hole part with an elastic force from an outer side.

14. The multi pencil according to claim 10 further comprising a holding member configured to be arranged on a rear portion of the screw tube and hold the movable body inside, wherein a cross section of the movable body is formed in a non-circular shape, and wherein the holding member includes a hole part formed in a non-circular shape in accordance with a cross-sectional shape of the movable body.

15. The multi pencil according to claim 14, wherein the holding member includes an elastic portion configured to provide the movable body inserted in the hole part with an elastic force from an outer side.

16. The multi pencil according to claim 1 further comprising a pipe member configured to be positioned in an interior of the leading tube, the pipe member in which the drawing material is loaded;

a movable body configured to extend in an axial direction on a rear portion of the drawing material and configured to include a male screw having infinitesimal pitches on an outer circumference; and a screw tube configured to be synchronously rotatably engaged with a rear side of the pipe member and configured to include a female screw that is threadedly engaged with the male screw on an inner circumference, wherein the sliding part moves forward by a constant distance with respect to the main body, which allows the pipe member to move forward and engage the leading tube in a rotational direction, and wherein, in this state, the leading tube and the main body are relatively rotated in the one direction, whereby the movable body moves forward with the drawing material by action of a screw-threaded engagement between the male screw and the female screw.

17. The multi pencil according to claim 16, wherein a front end of the movable body is formed in a cylindrical shape having a flat bottom surface, and wherein the bottom surface thrusts the drawing material forward, which allows the drawing material to move forward.

18. The multi pencil according to claim 17 further comprising a holding member configured to be arranged on a rear portion of the screw tube and hold the movable body inside, wherein a cross section of the movable body is formed in a non-circular shape, and wherein the holding member includes a hole part formed in a non-circular shape in accordance with a cross-sectional shape of the movable body.

19. The multi pencil according to claim 18, wherein the holding member includes an elastic portion configured to provide the movable body inserted in the hole part with an elastic force from an outer side.

20. The multi pencil according to claim 16 further comprising a holding member configured to be arranged on a rear portion of the screw tube and hold the movable body inside, wherein a cross section of the movable body is formed in a non-circular shape, and wherein the holding member includes a hole part formed in a non-circular shape in accordance with a cross-sectional shape of the movable body.

21. The multi pencil according to claim 20, wherein the holding member includes an elastic portion configured to provide the movable body inserted in the hole part with an elastic force from an outer side.

22. The multi pencil according to claim 1 further comprising a pipe member configured to be positioned in an interior of the leading tube, the pipe member in which the drawing material is loaded;

a movable body configured to extend in an axial direction on a rear portion of the drawing material and configured to include a male screw having infinitesimal pitches on an outer circumference; and a screw tube configured to be synchronously rotatably engaged with a rear side of the pipe member and configured to include a female screw that is threadedly engaged with the male screw on an inner circumference, wherein the sliding part moves forward by a constant distance with respect to the main body, which allows the pipe member to move forward and engage the leading tube in a rotational direction, and wherein, in this state, the leading tube and the main body are relatively rotated in the one direction, whereby the movable body moves forward with the drawing material by action of a screw-threaded engagement between the male screw and the female screw.

23. The multi pencil according to claim 22, wherein a front end of the movable body is formed in a cylindrical shape having a flat bottom surface, and wherein the bottom surface thrusts the drawing material forward, which allows the drawing material to move forward.

24. The multi pencil according to claim 23 further comprising a holding member configured to be arranged on a rear portion of the screw tube and hold the movable body inside, wherein a cross section of the movable body is formed in a non-circular shape, and wherein the holding member includes a hole part formed in a non-circular shape in accordance with a cross-sectional shape of the movable body.

25. The multi pencil according to claim 24, wherein the holding member includes an elastic portion configured to provide the movable body inserted in the hole part with an elastic force from an outer side.

26. The multi pencil according to claim 22 further comprising a holding member configured to be arranged on a rear portion of the screw tube and hold the movable body inside, wherein a cross section of the movable body is formed in a non-circular shape, and wherein the holding member includes a hole part formed in a non-circular shape in accordance with a cross-sectional shape of the movable body.

27. The multi pencil according to claim 26, wherein the holding member includes an elastic portion configured to provide the movable body inserted in the hole part with an elastic force from an outer side.

* * * * *